US009926179B2

(12) United States Patent
Arzouman

(10) Patent No.: US 9,926,179 B2
(45) Date of Patent: Mar. 27, 2018

(54) COMMERCIAL LIFTING DEVICE-POWER UNIT WITH SAFETY MECHANISM

(71) Applicant: Salvatore Cala, Sunnyvale, CA (US)

(72) Inventor: Harry H Arzouman, Corona del Mar, CA (US)

(73) Assignee: Salvatore A Cala, Sunnyvale, CA (US)

( * ) Notice: Subject to any disclaimer, the term of this patent is extended or adjusted under 35 U.S.C. 154(b) by 121 days.

(21) Appl. No.: 13/998,484

(22) Filed: Nov. 4, 2013

(65) Prior Publication Data

US 2015/0123055 A1 May 7, 2015

(51) Int. Cl.

| | |
|---|---|
| ***B66F 17/00*** | (2006.01) |
| ***B66F 5/04*** | (2006.01) |
| ***B66F 13/00*** | (2006.01) |
| ***B66F 1/08*** | (2006.01) |

(52) U.S. Cl.

CPC ..... *B66F 17/00* (2013.01); *B66F 5/04* (2013.01); *B66F 1/08* (2013.01); *B66F 13/00* (2013.01)

(58) Field of Classification Search

CPC ..... B66F 1/08; B66F 5/04; B66F 5/02; B66F 13/00

See application file for complete search history.

(56) References Cited

U.S. PATENT DOCUMENTS 4,251,056 A * 2/1981 Maniglia ..... B66F 5/04 254/8 B
4,289,298 A * 9/1981 Kameda ..... B66F 5/04 254/8 B
4,289,299 A * 9/1981 Kameda ..... B66F 5/04 254/8 B
5,878,996 A * 3/1999 Loan ..... B66F 5/04 254/8 B
6,663,081 B1 * 12/2003 Arzouman ..... B66F 5/04 254/8 B
7,413,169 B2 * 8/2008 Arzouman ..... 254/8 B
2003/0218155 A1 * 11/2003 Arzouman ..... B66F 5/04 254/1

(Continued)

*Primary Examiner* — Christopher M Koehler
*Assistant Examiner* — Seahee Yoon
(74) *Attorney, Agent, or Firm* — Useful Arts IP

(57) ABSTRACT

A power unit (or a hydraulic floor jack) includes a rectangular frame with side flanges and has a tubular handle enclosing a control shaft and a control knob. A pivotal lifting mechanism is mounted on the frame including a pair of parallel lift arms having rearward ends interconnected by a lateral push bar. The forward ends (with the bridge) are rotatable upward for lifting a load as the push bar is translated forward within a pair of U channels tracks attached to the inner side flanges. A hydraulic cylinder has a ram for pushing the lateral push bar forward along the tracks for raising the forward ends of the lift arms, and has a releasable control valve for retracting the ram to lower the forward ends of the lift arms. The safety mechanism includes a toothed rack bar secured in the vertical wall of the racks. The lateral push bar has bore holes in the ends thereof. A cylindrical dog is slidably supported within each of the bore holes ad has a proximal end that is extendable for engaging a tooth of the rack bar. The dogs are biased into the extended position, and include release cables and linkage for releasing the dogs from the rack bar by rotating the control knob counter-clockwise.

5 Claims, 15 Drawing Sheets

(56) References Cited

U.S. PATENT DOCUMENTS

| | | | | |
|---|---|---|---|---|
| 2008/0099740 | A1* | 5/2008 | Arzouman | B66F 5/04 254/8 B |
| 2008/0099742 | A1* | 5/2008 | Arzouman | B66F 5/04 254/8 B |
| 2008/0099744 | A1* | 5/2008 | Arzouman | B66F 1/08 254/8 B |
| 2008/0173852 | A1* | 7/2008 | Woodbury | B66F 5/04 254/8 B |
| 2012/0223280 | A1* | 9/2012 | Zhou | B66F 5/04 254/8 B |

* cited by examiner

230

230

COMMERCIAL LIFTING DEVICE-POWER UNIT WITH SAFETY MECHANISM

CROSS REFERENCE TO RELATED APPLICATIONS

Applications have been filed directed to a Commercial Lifting Device—Power Unit with Leveling Pads, Commercial Lifting Device—Power Unit with Slide Forward Bridge, Commercial Lifting Device—Power Unit with Bridge Latching, Commercial Lifting Device—Power Unit with Safety Mechanism, Commercial Lifting Device—Jack Stand, and Rack for Transporting Jack Stands.

BACKGROUND OF THE INVENTION

The invention relates to a system for lifting and supporting an object; particularly to a two part jacking system including a power unit that can be used to place and elevate a jack stand for lifting and supporting a corner of a vehicle. The two part system is inherently safer to use than a conventional floor jack to elevate a vehicle, and which then requires the user to crawl under the vehicle to try to place a convention jack stand adjacent to the elevated floor jack to support the load. The inventor of the present invention is a pioneer of the two part jacking system and holds numerous patents related to this technology.

Briefly, the two part jacking system consists of a mobile hydraulic power unit having a flat front base and extendable lift arms with leveling pads; and a set of separate mechanical jack stands that can be secured within the front base of the power unit, and elevated by extending the lift arms of the power unit, and locked by an integral ratchet locking mechanism. An example of the two part jacking system describing the power unit is shown in U.S. Pat. No. 7,410,148 (see FIGS. 1 and 9); and an example of the jack stand is also shown and described (see FIGS. 2-8).

In use, the jack stand is engaged within (and can be disengaged from) the front base of the power unit, and is maneuvered into position, i.e. under a vehicle, to place the stand in a desired location for lifting and supporting the vehicle. The power unit is activated by pumping the handle, raising the lift arms, and the stand is thereby extended vertically to the desired height, locked in position, thus lifting and supporting the vehicle on the stand. By operating the controls at the end of the handle, the power unit lift arms are lowered, and the power unit is disengaged from the stand and pulled away, leaving the stand in position supporting the vehicle. The power unit is then free to position and extend another stand for elevating another corner of the same or another vehicle.

To lower the vehicle and remove the stand, the power unit is maneuvered into position to re-engage with the stand. By operating the controls at the end of the handle, the power unit is re-engaged with the base of the stand and the lift arms are elevated to the height of the extended jack stand. The controls can then be operated to disengage the ratchet locking mechanism of the stand, and the lift arms are released to lower the stand to its original position. The power unit remains engaged with the stand and can be pulled away from the vehicle with the stand carried within the base.

The early design of the power unit and jack stands were for consumer use, and has later evolved also into commercial use. The commercial use requires higher capacity of 3-4 tons for heavier cars and trucks with many duty cycles of use each work day. The prior system was improved with heavier gauge materials, but had a relatively short life due to failure of one or both of the leveling pads or frusta-conical roller bearing on the leveling pad, for lifting the jack stand supporting the load. The leveling pads and the roller bearings were repairable, but it has been determined to improve the design for the required capacity and extended life for commercial use.

The early designs of the power unit were adapted to carry up to four jack stands within the base; current models carry only one or two stands. Additional stands could be acquired to reload the power unit, so that a single power unit could be utilized to efficiently place and actuate numerous stands. Many commercial users employed the system for multiple ongoing projects, and would utilize all of their available stands. The power unit was thereafter useless until another stand was available, from a completed project, to be extracted and reused on a new project The present inventor developed a "bridge" lifting plate positioned to bridge between the forward ends of the lift arms and adapts the power unit to function as a hydraulic floor jack, to more fully utilize the power unit. The present inventor also developed a bridge plate that could travel along the lift arms, and that was biased by compression springs toward the forward ends of the lift arms and onto the leveling pads to provide an "automatic slide forward bridge". The vertical housing of the jack stand(s) would force the bridge rearward on the lift arms. When there were no more stands within the base of the power unit, (and when the lift arms were in the lowered position) the bridge would automatically slide forward onto the leveling pads at the forward ends of the lift arms. The power unit then functioned directly as a hydraulic floor jack.

The automatic slide forward bridge mechanism has been revised to include various design improvements. An example of a recent improvement is described in U.S. Pat. No. 7,410,148 (see FIGS. 32-34). This prior art bridge mechanism utilized a pair of compression springs enclosed within pairs of telescoping tubes to bias the bridge toward the forward ends of the lift arms.

This improved prior art design was functional, but did not always reflect the sliding reliability and durability as desired for the system, particularly for commercial applications of the system. Due to component variance, time and wear, the forces exerted by the compression springs were not always equal. The use of compression springs to bias the bridge forwardly required alignment and support of the springs by the telescopic tubes. Once a compression spring or one of the surrounding tubes became kinked or distorted, it needed to be replaced. Tension springs tend to be less expensive, self aligning, durable and do not require telescopic tubular side support. It was determined that the mechanism would be more reliable and durable if the bridge could be biased forwardly utilizing tension springs.

The various designs of the automatic slide forward bridge included a continuous bias forward of the bridge every time a jack stand was released from the power unit. In most cases, the power unit would be used sequentially with another jack stand and the bridge was not required or desired. This produced unnecessary wear on the bridge mechanism and continuous effort by the next jack stand to reposition the bridge rearward in the lift arms. It was determined that a latching system to retain the bridge in the middle position (rearward of the jack stand) was needed, until it was desired to release the bridge and utilize the power unit as a load lifting jack.

The use of a slide forward bridge with the power unit acting as a floor jack is best utilized with a safety mechanism to lock the elevated lift arms in position, in the event of any decay of hydraulic pressure while elevated. Such a device is described in U.S. Pat. No. 7,413,169 (see FIGS. 35-37). The device was automatically deployed every time the lift arms were raised, and required release by a separate control lever to lower the lift arms. This resulted in a problem in that the operators would sometimes forget to release the lever and the lift arms were locked in position until the operator remembered the control lever.

Another problem was presented for the jack stand due to the redesign to improve the operation of the automatic slide forward bridge. The bridge has been designed to slide along the lift arms at a more rearward position and the vertical base (or lifting plate) of the jack stand did not force the bridge sufficiently rearward to reposition the jack stand within the base of the power unit. It was determined that an elevated extended bumper was required on the vertical base of the jack stand.

The redesign of the system of the present invention resulted in a power unit having only one jack stand and a larger slide forward bridge mechanism within the base. Commercial user required numerous jack stands within the shop, and also included some mobile service to remote sites for vehicle service and repairs. It was necessary to transport two or more jack stands to various location for use with the various power units. It was determined that a mobile rack was needed to efficiently transport the jack stands required for use by the power unit.

In view of the foregoing problems, it is an object of the present respective invention to provide an improved power unit with leveling pads having a capacity of at least 3 tons and extended use;

It is another object to provide a power unit having an improved slide forward bridge mechanism having a capacity of at least 3 tons that is precisely aligned, smoothly operated by tension springs, and reliable and durable in operation.

It is another object to provide a power unit having a releasable latch mechanism for retaining the slide forward bridge in the middle position of the lift arms, until needed;

It is another object to provide an improved power unit having a safety mechanism for securing the lift arms when the slide forward bridge is in use, and which is automatically released when the lift arms are lowered;

It is another object to provide a jack stand that effectively pushes the slide forward bridge into the middle position when the jack stand is positioned into the front base of the power unit;

It is another object to provide a jack stand having a base plate that facilitates securing the jack stand into the mobile rack; and It is another object to provide a mobile rack for transporting two or more jack stands to various locations for use by the power unit.

SUMMARY OF THE INVENTION

The foregoing object of providing a safety mechanism for securing the lift arms when the bridge is in use is accomplished by the power unit of the present invention. The power unit includes a rectangular frame having a tubular control handle with a control knob at the upper end of the handle. The frame has a pair of side flanges, and a pivotal lifting means mounted on the frame including a pair of parallel lift arms having rearward ends interconnected by a lateral push bar and having forward ends (with the bridge) rotatable upward for lifting a load. A pair of U channels tracks having rack bars therein, face inward and are attached to the inner side flanges and retain the ends of the push bar therein. A hydraulic cylinder has a ram for pushing the lateral push bar forward along the tracks for raising the forward ends of the lift arms, and has a releasable control valve for retracting the ram to lower the forward ends of the lift arms.

The tubular handle enclosing a control shaft extends from the control knob to the control valve; the control knob is rotatable in the clockwise direction to close the valve and is rotatable in the counter-clock-wise direction to release the valve. The control shaft further has a radial arm extending near the control valve.

The lateral push bar has a bore hole in the ends with a cylindrical dog slidably supported therein. The dogs have a proximal end and have a distal end with biasing means for engaging the distal end into a respective tooth of the rack bar, for mechanically securing the push bar as it is advanced within the tracks. The lift arms are retained in the respective elevated position independent of any release of pressure by the hydraulic cylinder. The lateral push bar further has a slotted opening therein communicating each central bore with the surface of the push bar, for receiving a release cable therein. A control disc is oriented horizontally and pivotally connected at the center thereof to the lateral push bar. A release cable (slidable within a cable sheath) has a distal end connected to the proximal end of each the dog, and has a proximal end connected near the perimeter of the pivotal disc, whereby a pivotal rotation of the disc will pull the release cable to retract each the dog from engagement with the rack bar.

a control cable (slidable within a sheath) has a distal end attached to the perimeter of the pivotal disc, and has the proximal end attached to the radial arm on the control shaft, whereby a counter-clockwise rotation on the control knob will release the control valve, and will pull the control cable for rotating the disc to also release the dogs from the rack bar.

BRIEF DESCRIPTION OF THE DRAWINGS

While the novel features of the invention are set forth in the appended claims, the invention will be better understood along with other features thereof from the following detailed description taken in conjunction with the drawings, in which:

(as shown in FIG. 1)

DETAILED DESCRIPTION OF THE INVENTION

The figures and the following specification describe several distinctive inventions that are interrelated within a lifting and supporting system, and may be included in patents (or pending applications) having distinctive sets of claims directed to the respective invention. The improved power unit, and jack stand are discussed and described in terms of an automotive jack system, but it should be understood that the system is not limited to automotive uses and can be utilized for lifting and supporting any type of load in any environment.

The improved design and features result in improved performance, reliability and durability of the jacking system. The commercial system is introduced in a 3-ton capacity model and a 4 ton capacity model, each having a lifting range from about 7 inches to a maximum of about 19 inches for the jack stand and for the power unit.

Commercial Lifting System

Figure 1:
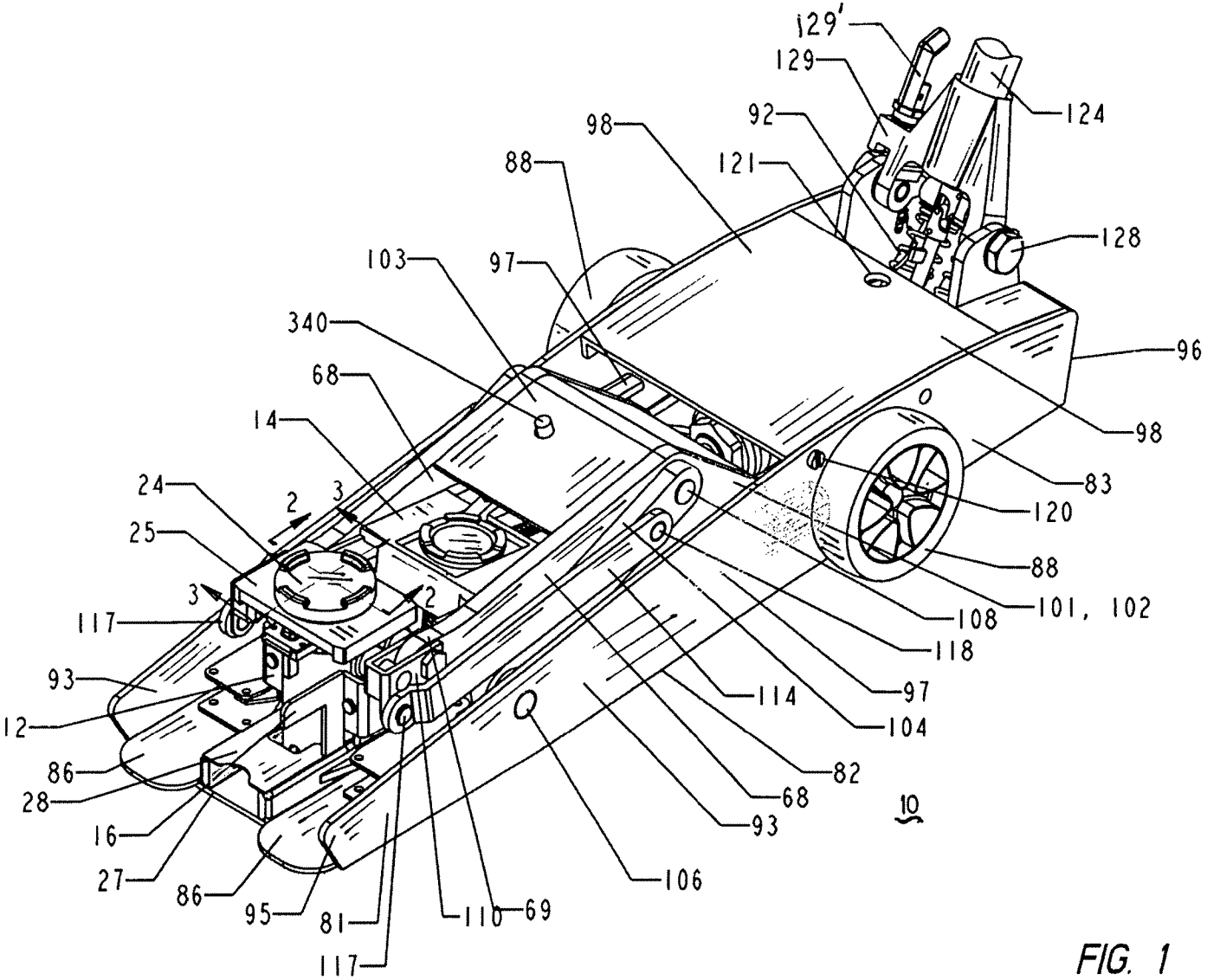
FIG. 1 is top-front perspective view of a power unit carrying a jack stand.
Figure 3:
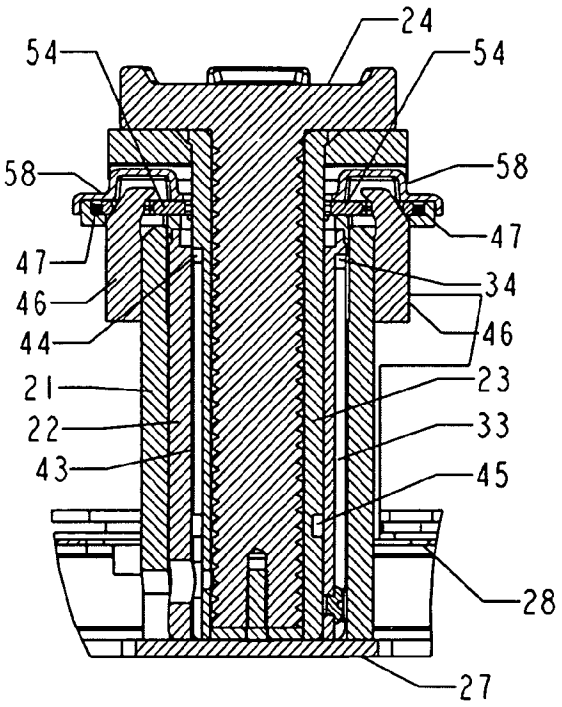
FIG. 3. is side elevational sectional view of the jack stand taken along 3-3 of FIG. 1.
Figure 2:
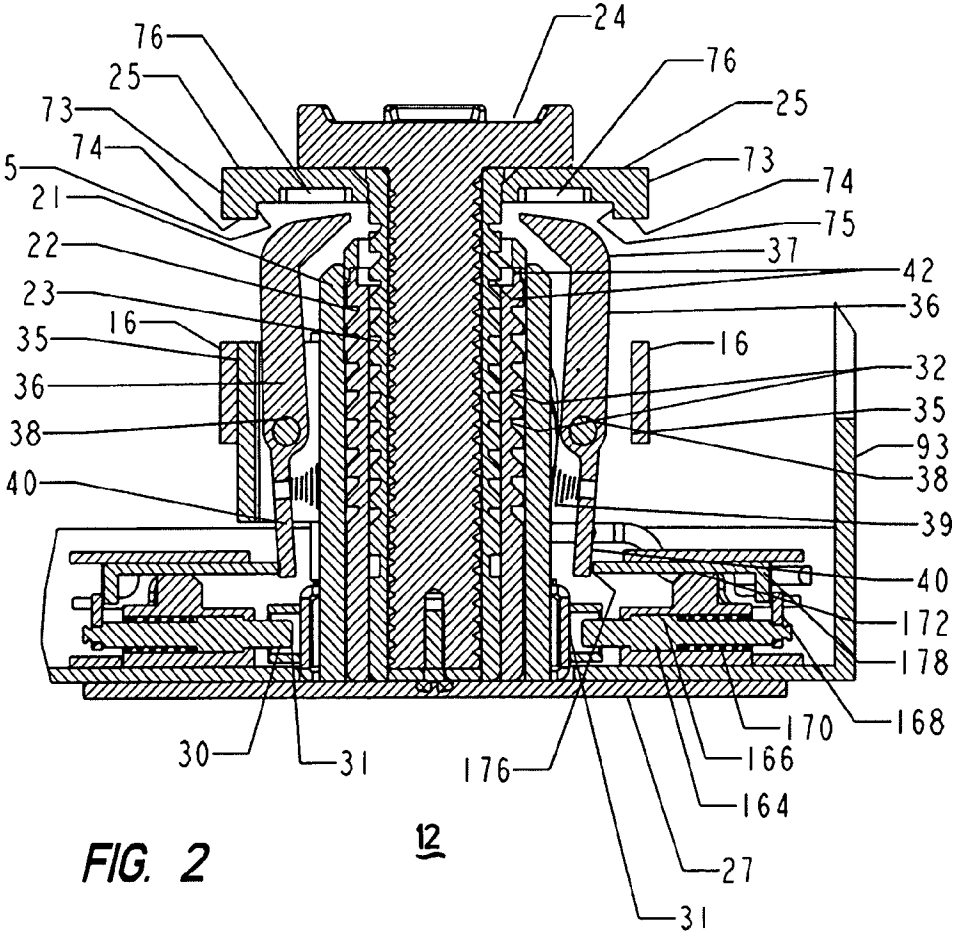
FIG. 2. is a front elevational sectional view of the jack stand taken along 2-2 of FIG. 1.
Figure 5:
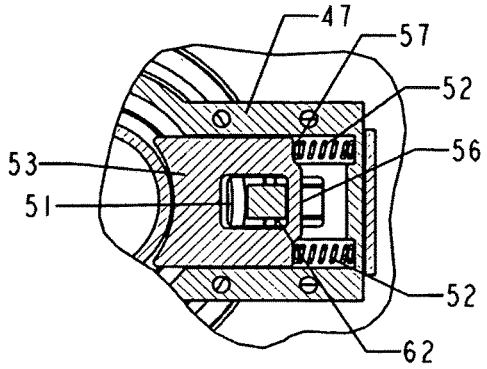
FIG. 5 is a sectional view taken along 5-5 of FIG. 4 showing the second frame locked to the third frame (prior to the lifting of the second frame)
Figure 6:
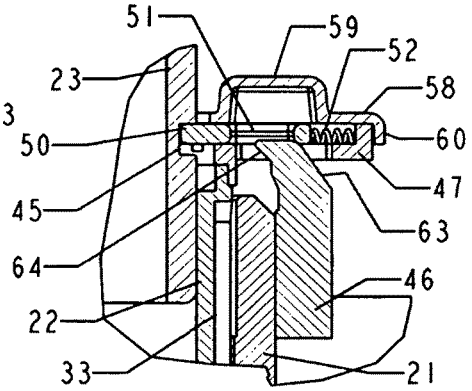
FIG. 6 is sectional view taken along 6-6 of FIG. 4.

Referring first to FIG. 1, there is shown a commercial power unit 10 of the present invention for use with one or more commercial jack stands 12 for lifting and supporting a load. The power unit is also readily convertible, by a slide forward bridge 14, for use directly as a hydraulic floor jack. The jack stand is designed to have a very low initial height, and the power unit is designed to be very sleek, having a smooth, arcuate, low-profile for maneuvering into low lifting applications and has a unique functional and industrial appearance. The system will be discussed in terms of its structure including significant improved features, by the use of descriptive sub-headings.

Commercial Jack Stand

Referring also to FIGS. 2-4 and 9, the jack stand 12 includes a horizontal base assembly 26, a vertical tubular first frame 21 which is fixedly attached to the base assembly, a vertical tubular second frame 22 which is telescopically extendible within the first frame, and a vertical tubular third frame 23 which is telescopically extendible within the second frame. There is an optional vertical fourth frame 24 (a screw-out saddle) threaded into the upper end of third frame 23. The third frame 23 has a unique lifting plate 25 on the upper end thereof for engagement by the lift arms of the power unit 10.

The base assembly 26 is for aligning the jack stand 12 within the power unit 10, and includes a bottom plate 27, an upper plate 28 supported on side walls, and a pair of lateral ramps 30, each having a lateral aligning hole 31 therein, and are each secured to the respective side wall forming side rails thereon. The lateral ramps 30 initially provide side rails, above and parallel with the bottom plate 27, that are engagable by a pair of separated forward extensions 86 at the forward end 81 of the power unit. The forward extensions straddle the base assembly 26, for loading the jack stand into the power unit, as shown in FIG. 1. The lateral ramps and aligning holes are further utilized for locking the jack stand into the frame of the power unit.

The tubular first frame 21 has a lower end that extends downward through the upper plate 28 of base assembly 26 and is welded to the bottom plate 27. The second frame 22 has vertical rows of ratchet teeth 32 formed on two opposite sides of its outer surface. In order to maintain the rotational orientation of the ratchet teeth 32 relative to base assembly 26, there is a vertical groove 33 formed at one point on the circumference of the outer surface of second frame 22 and which extends throughout most of the length of the second frame. A short pin 34, secured through an opening in the first frame 21, extends into the groove 33 and thus secures the second frame 22 against rotation (see FIG. 3).

The bottom plate 27 and the lifting plate 25 of the jack stand 12 each have several unique features that were required by the redesign of the power unit 10. The power unit was redesigned for more durability and lifting capacity (and will be discussed in detail within the sub-heading Commercial Power Unit). Briefly, the power unit was redesigned with a larger stronger U-shaped leveling pad 110 having two cylindrical roller bearings 115 each with a circular inner radial flange 116 thereon and pivotally attached to the forward ends of each lift arm (see FIG. 11). Also, the bridge 14 was redesigned and re-positioned within the lift arms and could no longer be forced to the rearward position by the lifting plate of the jack stand, and required a new bumper 16. Further, a new mobile rack 350 (see FIG. 17) was developed for transporting two or more jack stands (and will be discussed in detail within sub-heading Mobile Rack for Transporting Jack Stands) and required the addition of unique openings 78 in the bottom plate of the jack stand for engaging the rack.

Figure 9:
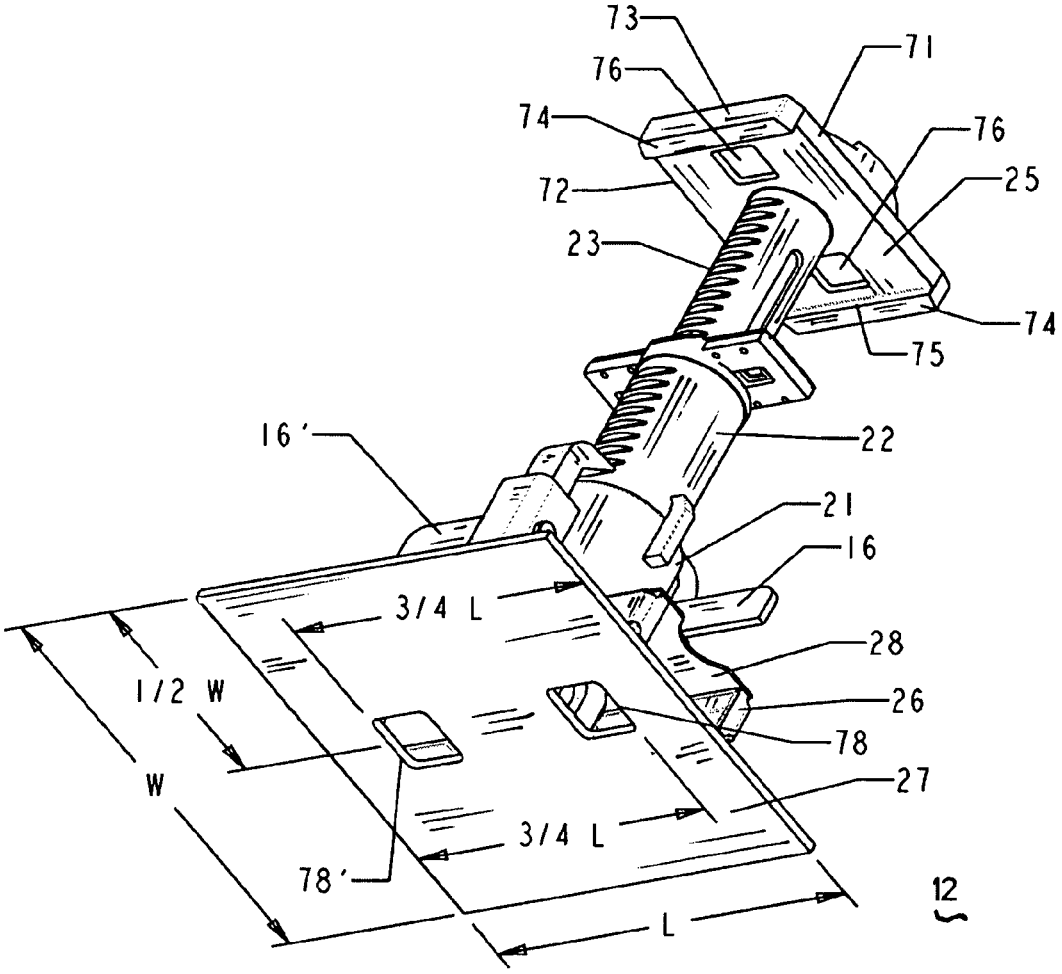
FIG. 9 is a bottom-front perspective view of the jack stand, with the jack stand extended.
Figure 12:
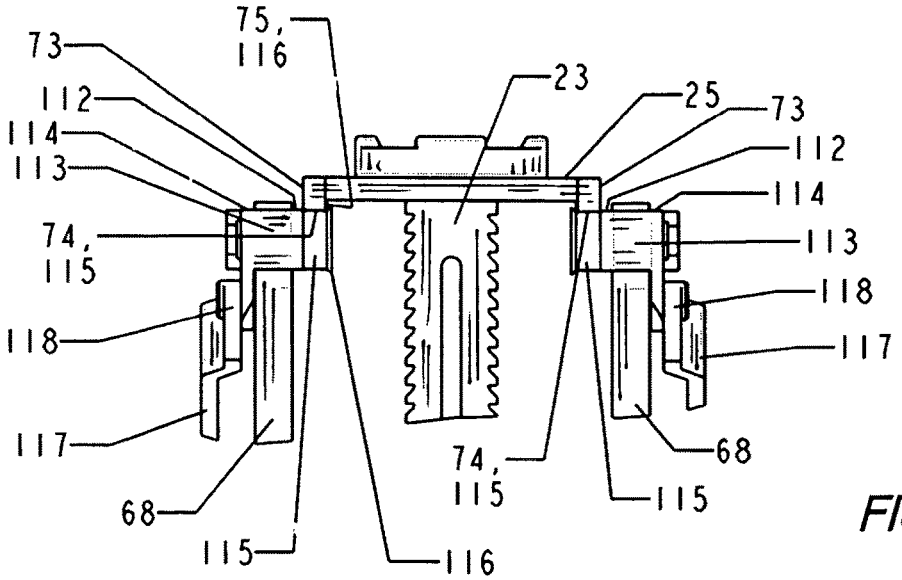
FIG. 12 is a fragmented front view, showing the engagement of the leveling pads with an upper lifting plate of the jack stand.

Referring particularly to FIG. 9, and to FIG. 12, there is shown the improved rectangular lifting plate 25 of the present invention, attached to the upper end of the third frame 23. The lifting plate has a forward end 71, a rearward end 72, side flanges 73 extending downwardly having a rectangular bottom surface 74 and with a vertical inner surface 75.

The rectangular bottom surface 74 of the flange 73 has a width about equal to the width of the cylindrical roller bearings 115 of the power unit. Whenever the leveling pads 110 of the power unit 10 engage the lifting plate 25 of the jack stand, the bottom surfaces of the flanges are supported on the four cylindrical roller bearings 115, and are further retained by the engagement of the vertical inner surfaces 75 within the circular radial flange 116 of each roller bearing.

This engagement results in the jack stand having a significant increase in lifting capacity, stability and durability.

The underside of the lifting plate 25 further includes rectangular recesses 76 for nesting the lifting plate over a pair of ratcheting arms (at the upper end of first frame 21) when the jack stand 12 is lowered. This provides a lower profile for the jack stand to fit under shorter loads.

Figure 10:
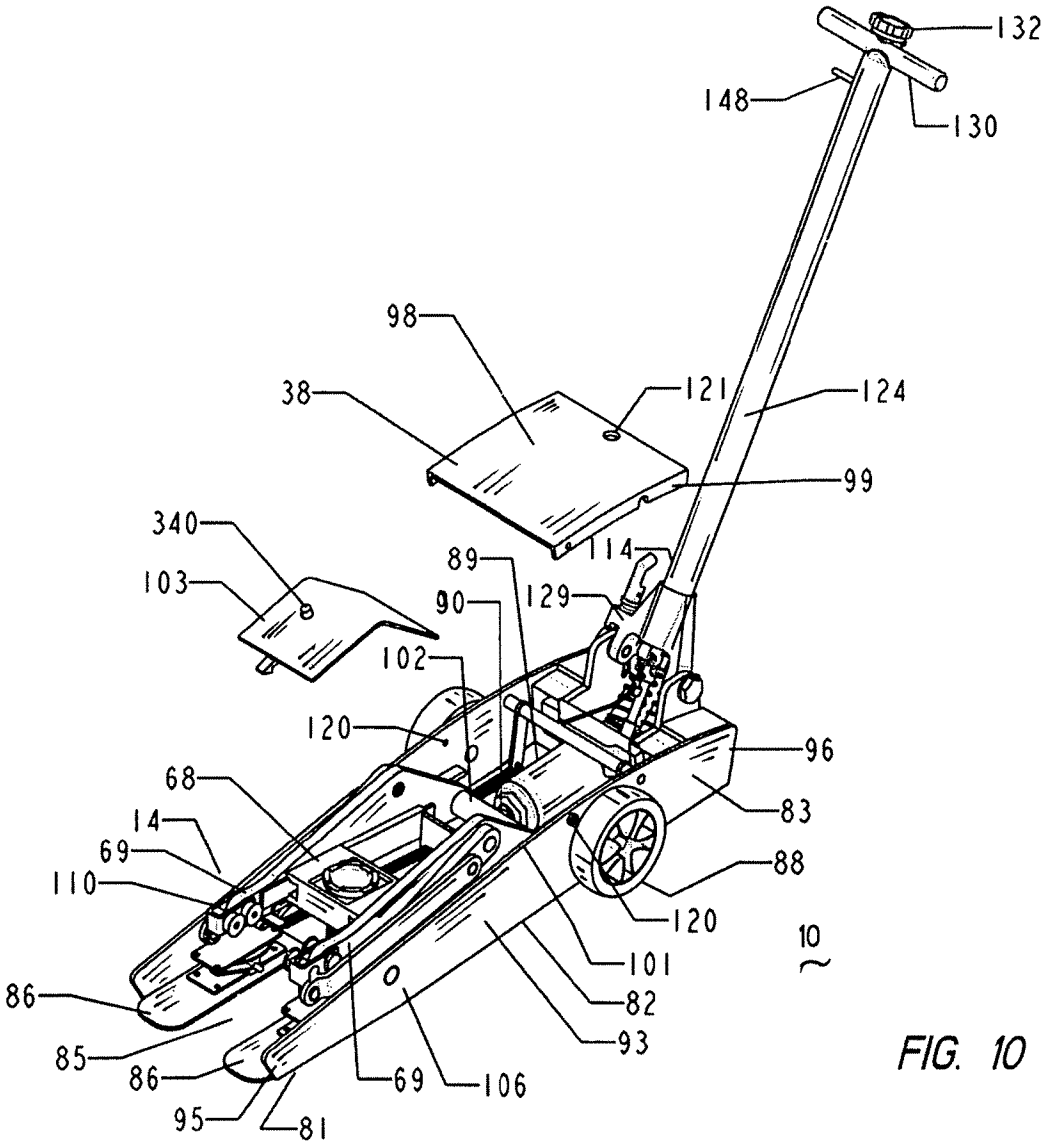
FIG. 10 is a front perspective, partially exploded, view of the power unit without the jack stand, and showing a slide forward bridge in the middle position within the lift arms.
Figure 13:
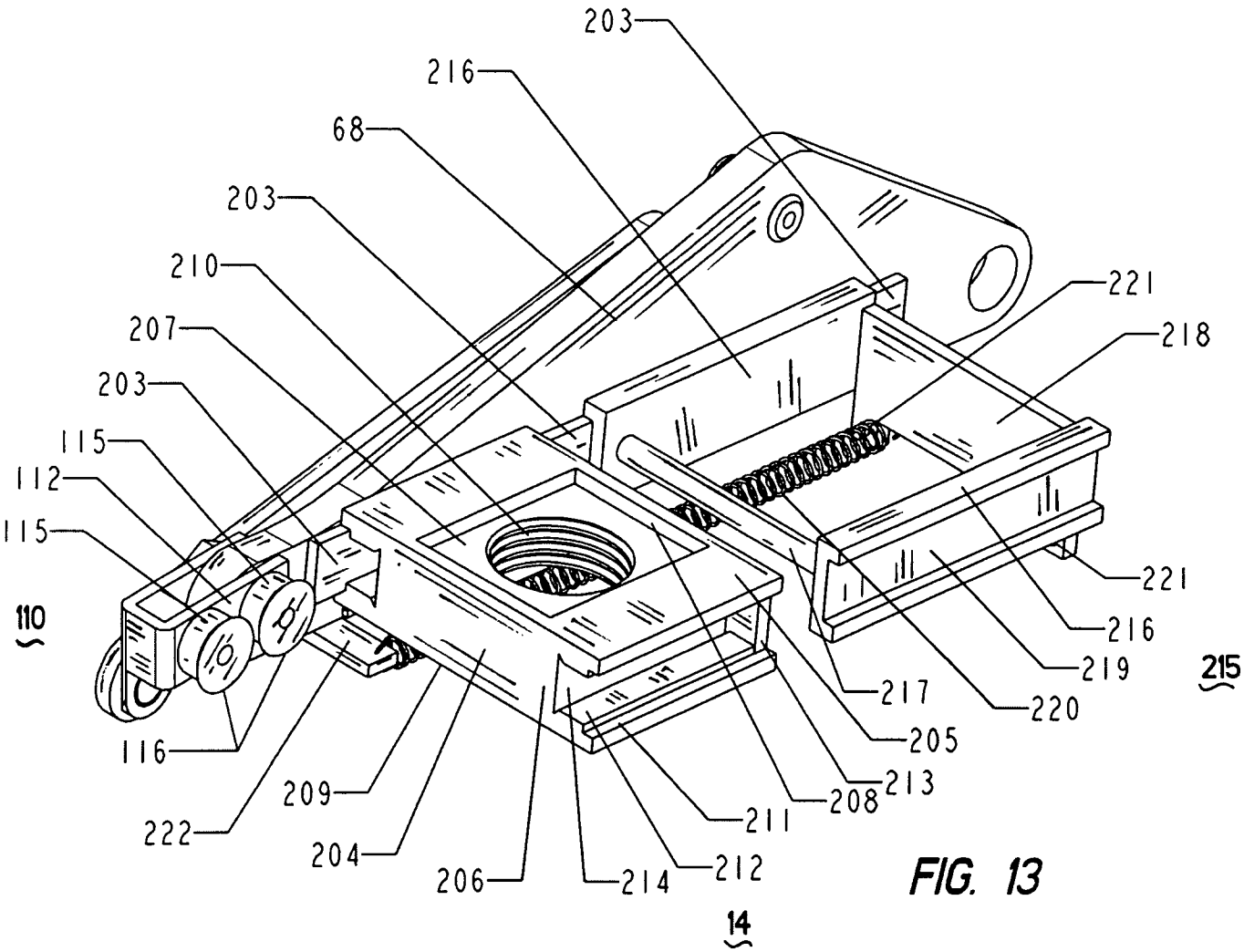
FIG. 13 is a fragmentary front perspective view of one of the lift arms of the power unit, showing the bridge and a pusher frame slidable on a slide rail of the lift arm.

Referring now to FIGS. 10 and 13, the bridge 14 is shown in the middle position within the lift arms 68 of the power unit 10. The bridge travels along a low slide rail 203 within the lift arms, and can not be sufficiently engaged and so positioned by the first frame 21 or the end of lifting plate 25 of the jack stand 12. A new means is required for engaging the bridge.

Figure 4:
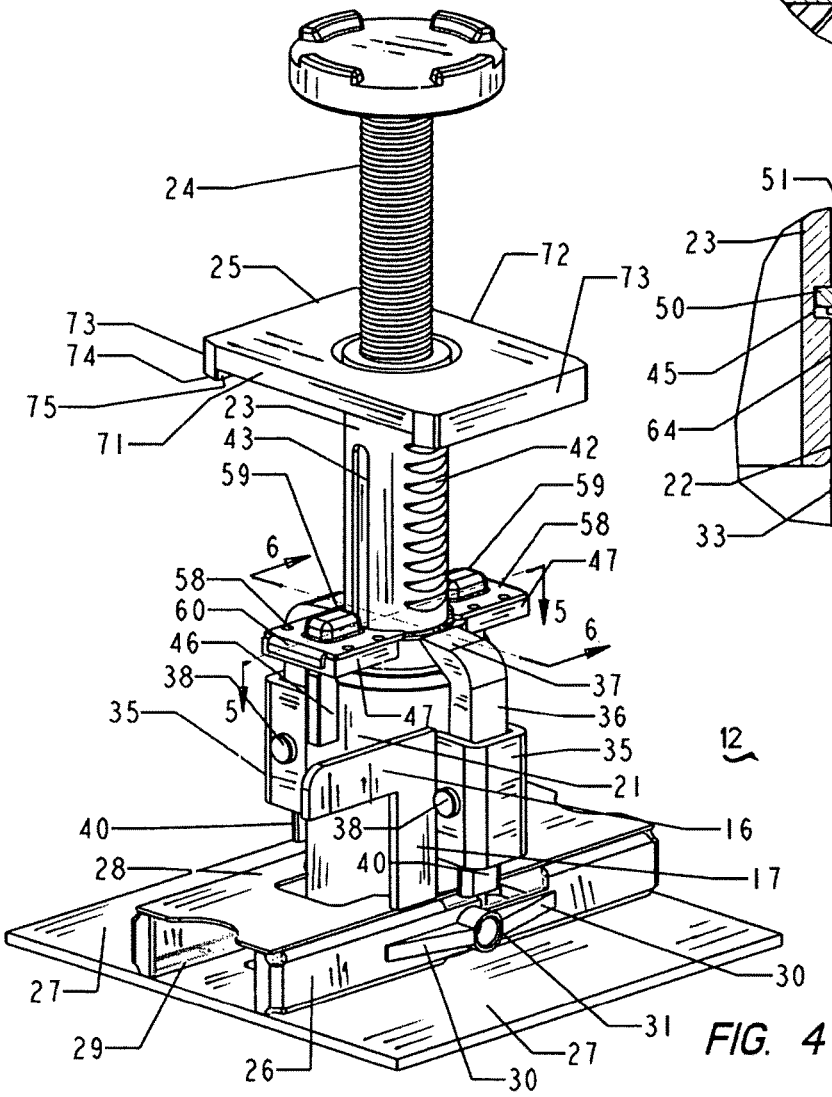
FIG. 4 is top-front perspective view of the jack stand having the third frame fully elevated.
Figure 8:
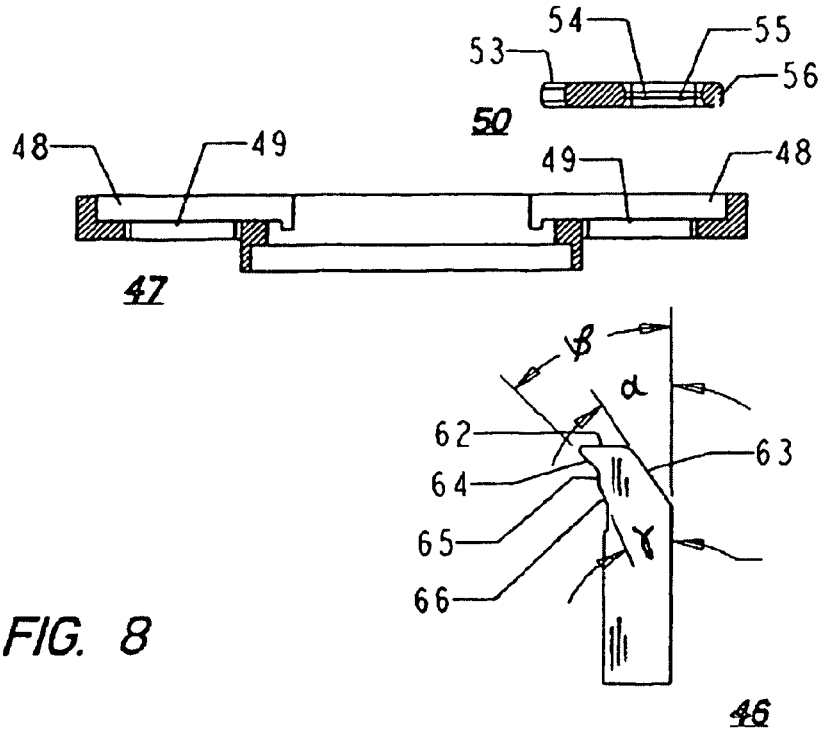
FIG. 8 is an exploded sectional side view of the components of FIG. 7.
Figure 7:
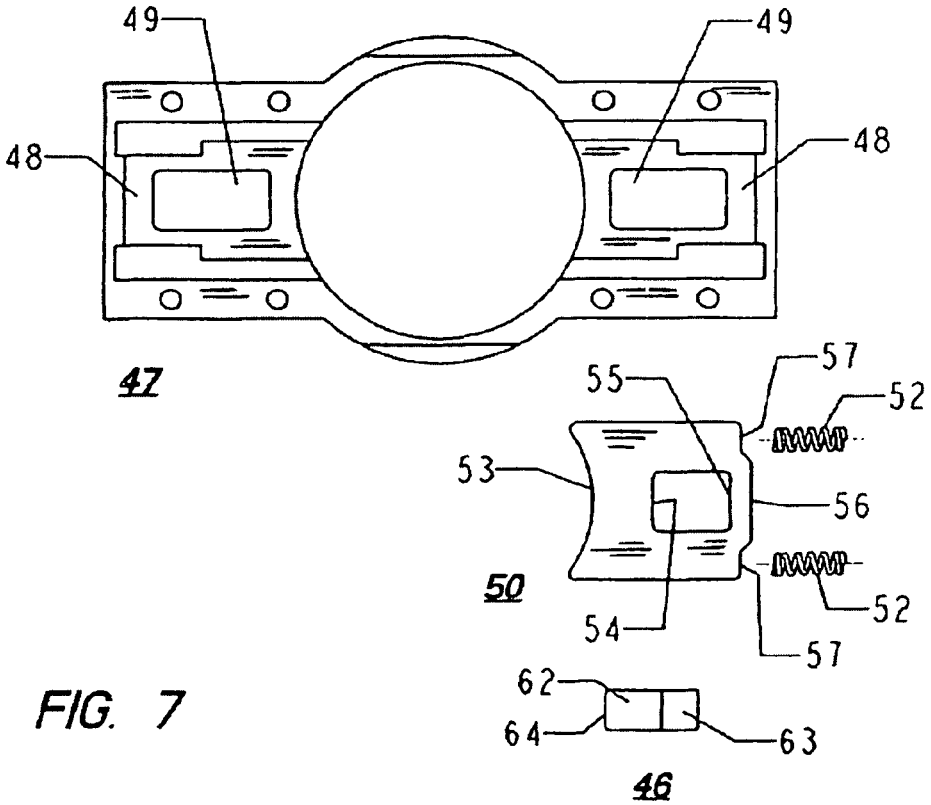
FIG. 7 is a top plan view of the components of the frame locking mechanism of the stand.

Referring particularly to FIG. 4, a bumper 16 is attached to the tubular first frame 21 of the jack stand 12. The bumper is positioned vertically above the bottom plate 27 to match the height of the bridge 14 (when the power unit is in the lowermost position), and extends forwardly over the forward end of the bottom plate. The distal end of the bumper is for engaging the forward end 204 of the bridge and forcing the bridge into the middle position within the lift arms 68, as the jack stand is loaded into the power unit.

The bumper 16 is attached to the tangential side of the tubular first frame 21, to avoid interference with the ratcheting mechanism of the jack stand 12. The bumper preferably includes an integral vertical portion 17 extending downward to the base assembly 26 of the jack stand. The vertical portion provides support for the bumper and provides a large area for attaching (welding) the bumper to the tubular first frame.

A duplicate bumper 16' is attached to the other tangential side of the vertical frame 21 and is similarly positioned vertically above the bottom plate 27 and extends rearwardly over the rearward end of the bottom plate; whereby the jack stand 12 can be loaded longitudinally into the power unit 10 from either end, with one of the bumpers engaging and positioning the bridge 14.

Figure 18:
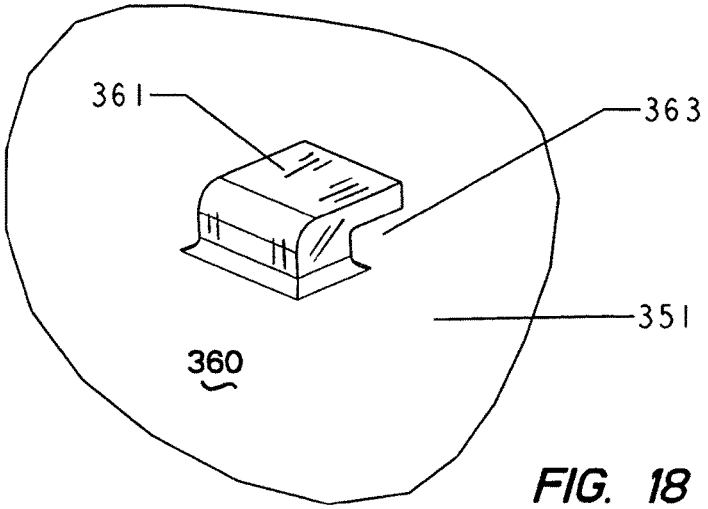
FIG. 18 is an enlarged view of one of the fingers extending from the platform of the rack of FIG. 17.
Figure 17:
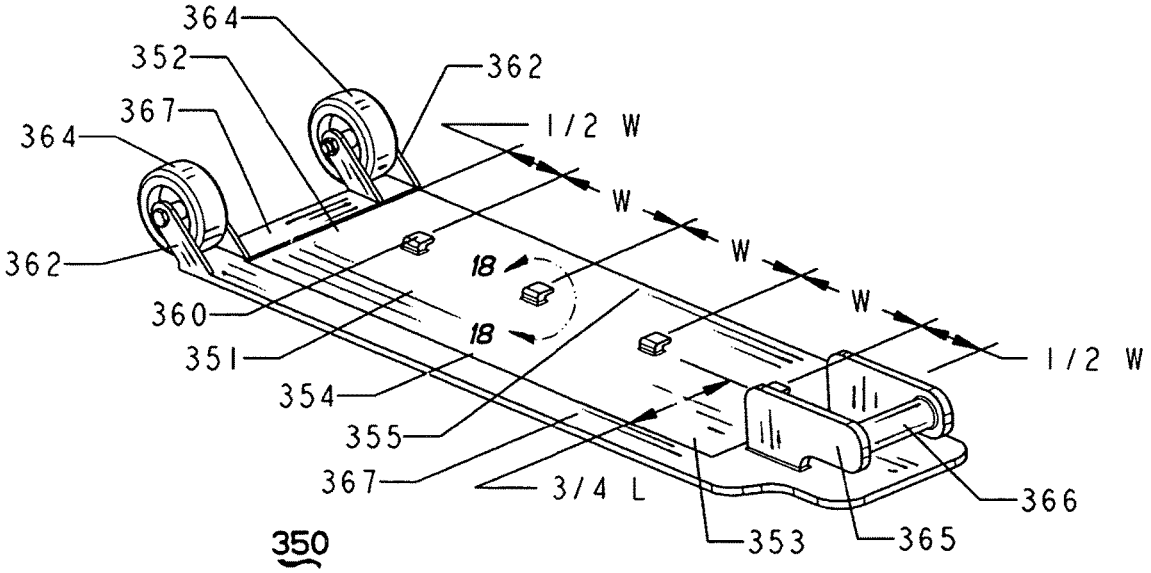
FIG. 17 is a top front perspective view of a first embodiment of a rack for transporting two or more jack stands.

Referring again particularly to FIG. 9, there is shown another improvement of the jack stand 12 for use with a mobile rack (350, as shown in FIG. 17) for transporting two or more jack stands. The rack, briefly, includes a rectangular platform 351 having a loading and unloading lateral side 354, and a non-loading lateral side 355. The platform includes a plurality of lateral L shaped fingers 360 extending upwardly and spaced longitudinally (in multiple widths W of the jack stand) along the platform, and laterally about ¾L (of the length L of the jack stand) from the loading side of the platform. Each rack finger include an upper rectangular surface 361 that has a width and length, and has an opening 362 (between the platform and the finger) slightly greater than the thickness of the bottom plate 27 of the jack stand. The openings of the fingers face the non-loading side of the platform (see FIGS. 17 and 18).

The bottom plate 27 of the jack stand 12 is shown having a longitudinal length L, and a lateral width W. The bottom plate has the rectangular opening 78 therein laterally centered and longitudinally about ¾L from the rearward end thereof. The rectangular opening has a width and length greater than the width and length of the rectangular upper surfaces 361 of the fingers on the platform of the rack 350; and is for positioning the jack stand over one of the rectangular fingers with the bottom plate resting on the platform of the rack. The bottom plate is then slid laterally toward the loading side of the rack, whereby the bottom plate is secured under the respective finger of the rack.

The bottom plate 27 further includes a duplicate rectangular opening 78' therein laterally centered and longitudinally about ¾L from the forward end thereof, and having the same width and length, whereby the jack stand 12 can be loaded from either end onto the mobile rack 350.

The improved jack stand 12 further incorporates the unique tooth and ratchet mechanism for raising and lowering the vertical frames of the jack stand, and the unique materials, hardness and design of locking cams, as invented and developed by the present inventor.

Referring particularly to FIGS. 2-9, the first frame 21 has a pair of ratchet arm housings 35 secured to opposite sides of its exterior surface and aligned with the ratchet teeth of the second frame 22. Within each such housing there is a vertically extending ratchet arm 36 having a tooth or pawl 37 formed on its upper end. Each ratchet arm is supported near its longitudinal center by a pivot pin 38 which is in turn secured within the corresponding housing. A tapered compression spring 39 forces the lower end of each ratchet arm outward so that the pawl 37 on its upper end will reliably engage the ratchet teeth of second frame 22 (or third frame 23). The lowermost end 40 of each ratchet arm 36 is exposed beneath the corresponding housing where a horizontal force may be applied for releasing the engagement of its pawl 37 with the ratchet teeth.

The tubular third frame 23 likewise has vertical rows of ratchet teeth 42 formed on two opposite sides of its outer wall surface, similarly as the second frame 22. Again, to maintain the rotational orientation of the ratchet teeth 42 relative to the base assembly 26 there is the vertical groove 43 formed in the surface of third frame 23 and which extends throughout most of the length of the third frame. The short pin 44 secured through an opening in the wall of second frame 22 extends into the groove 43 and thus secures third frame 23 against rotation.

As the power unit 10 elevates the lifting plate 25 of the jack stand 12, the third tubular frame 23 is extended upward and the ratchet teeth thereon are engaged by the ratchet arm pawls 37 to secure the third frame in position. The jack stand includes a dual locking mechanism for automatically locking the second frame in fixed relation to the first frame while the third frame is being raised, and for locking the third frame in fully extended relation to the second frame while the second frame is being raised (see FIG. 3).

The basic dual locking mechanism includes a pair of upwardly extending fingers 46 fixedly secured on opposite sides to the upper end of the first frame 21; a guide member 47 secured to the upper end of the second frame 22 and extending horizontally outward therefrom, and having a pair of opposed recessed channels 48 therein with slotted openings 49 therein for receiving upper ends 62 of the respective fingers; and a pair of latch members 50 each horizontally slidable in the recessed channels of the guide member and having a slotted opening 51 therein for receiving the upper end of one of the fingers. The mechanism includes a set of suitable compression springs 52 for urging the latch members inwardly along the guide member at the upper end of the second frame. The third frame 23 has a horizontal groove 45 in its outer surface near the lower end thereof for receiving the latch members when the third frame is fully extended (see FIGS. 4-6).

Each latch member 50 has a horizontally curved inner end 53 (conforming to the radius of the tubular frame 23) having a rounded nose thereon, and the slotted opening therein has an inward edge 54 and an outward edge 55 thereof for cooperating with the upper end of the respective finger 46. The latch member has an outer end 56 having suitable notches 57 for abutting one end of the springs 52 that are nested within the outer ends of the guide member 47. The latch members and the springs are slideably retained and enclosed within the guide member by a pair of covers 58 each having a dome 59 thereon providing clearance for the upper end of the fingers, and having side and outer end flanges 60 for fastening the cover to the upper surface of the guide member.

Each finger 46 has the upper end 62 extendable into the slotted openings 51 of the latch members 50. The upper end 62 has an angled outward surface 63 thereon that acts as a cam for engaging the outward edge 56 of the slotted opening in the latch member, and has an inward surface 64 that act as an angled notch for engaging with the inward edge 54 of the slotted opening of the latch member.

Each finger has the upper end 62 with the outward surface 63 thereof extending outwardly and downwardly suitably inclined at an angle "α" ranging from about 28° to about 38°, and preferably at about 32°. This cam angle of about 32° provides smooth engagement with the outward edge 55 of the slotted opening in the latch member 50 for sliding the latch member outwardly along the recessed channels 48 of guide member 47.

The upper end 62 has the inward surface 64 thereon suitably extending outwardly and downwardly at an angle "β" ranging from about 40° to about 50° and preferably at about 45° for a vertical distance of about the thickness of the latch member 50, and then having a generally vertical portion 65 extending downwardly a distance of about the thickness of the latch member. The vertical portion 65 of the inward surface acts as a recessed notch with the upper end 62 extending inwardly over the inward edge 54 in the slotted opening of the latch member 50 and thereby captures the second frame 22 against any premature upward movement. The angle of 45° (even at low range 40°) insures that there is no binding of the inward edge 54 with the finger during the engagement of the outward edge 55 by the angled outer surface 63 acting at 32° (even at high range 38°), and further provides a smooth gradual unlatching of the finger over this surface when the latch member slides into the groove 45 of the third frame 23 when the third frame is fully extended (see FIG. 6).

The inward surface 62 of the finger continues further with a clearance portion 66 that extends outwardly and downwardly inclined at a suitable angle "γ" ranging from about 18° to about 28° and preferably at an angle of about 23° a vertical distance of about the thickness of the latch member. This portion 66 of the upper end provides some tolerance and clearance for welding the finger to the first frame 21 and insures clearance with the latch member during use.

The fingers 46, guide member 47, and latch members 48 are suitably cast out of 4130-4140 carbon steel. It has further been determined that these components should be of about the same hardness, and preferably are heat treated to a hardness of about 40-45 Rockwell C. Extended life tests of the jack stands have shown that heat treatment of the components to a hardness of less than 40 Rockwell C results in excess wear; and hardness above 50 Rockwell C result in components than are too brittle that tend to break.

The above described components cast from 4130-4140 steel, heat treated to 40-45 Rockwell C, and having the contoured fingers and latch members as defined, provide reliable locking of the respective frames when the jack stand is raised; and provides reliable unlocking of the respective frames when the jack stand is lowered, over an extended long commercial use of the jack stand.

Commercial Power Unit—with Improved Leveling Pads

Referring now to FIGS. 1, and 10, the commercial power unit 10 is shown for use with the jack stand 12, and for use with the slide forward bridge 14. The power unit 10 has a generally rectangular frame with a forward end 81 for loading and unloading the jack stand, a middle portion 82 for securing the lifting mechanism, a rearward end 83 for controlling the power unit, and a bottom 84.

The bottom 84 has a rectangular slotted opening 85 (with a semi-circular rearward end, see also FIG. 15) therein extending longitudinal from the forward end to the middle portion thereof. The slotted opening is a little wider than the width of the base assembly 26 of the jack stand 12. The forward end has a pair of flat separated extensions 86 thereon extending from the slotted opening to the respective side of the bottom of the frame, for straddling the jack stands. The separated extensions are used to ride up over the bottom plate 27 of the jack stand, to straddle the base assembly and to engage the lower surface of the side rails and ramps 30, to retain and transport the jack stand within forward end 81 of the frame of the power unit 10.

The bottom 84 of the frame further has the forward end 81 thereof substantially flat for providing a solid lifting platform, and has the middle portion 82 and rearward end 83 thereof angled longitudinally upwardly for facilitating mobility of the power unit by a pair of wheels 88 located near the rearward end of the frame.

A hydraulic cylinder 89 having an extendable ram 90 at the forward end thereof, and having a rotatable control valve 91 (see FIG. 16) at the rearward end thereof; is attached along the longitudinal center near the rearward end 83 of the bottom 84 of the frame. The hydraulic cylinder preferably utilizes dual piston type actuators 92 having a first piston actuator for rapidly extending the ram with only a few strokes, until a load exceeding about 150 pounds is encountered; the second piston actuator then takes over to extend the ram (i.e. to lift the load) in the conventional manner.

The frame has a pair of longitudinal side flanges 93 extending upward from the bottom 84 thereof; and has the pair of wheels 88 attached to the outer sides of the flanges on lateral axels near the rearward end 83 thereof. Each side flange has a rounded vertical nose 95 at the forward end 81 thereof and a smooth generally vertical blunted tail 96 at the rearward end thereof, and has a smooth arcuate upper contour extending upwardly from the rounded nose to about the height of the wheels and then downwardly mating with the blunted tail, providing an attractive appearance for the frame of the power unit. Each flange further includes a "U" shaped longitudinal retaining channel 97 facing inwardly and attached horizontally along the inner sides of the middle portion thereof.

The rearward end 83 of the frame includes a generally rectangular rear cover plate 98 having downwardly extended side flanges 99, and extends along and within the rearward portion of the contour of the side flanges 93 of the frame, and covers the hydraulic cylinder 89 and some of the control mechanism within the frame. The rear cover plate is shaped to match the upper contour of the rearward portions of the upward side flanges of the frame, and provides some protection for the components and a clean appearance for the rear of the power unit 10. The rear cover plate is pivotally attached near the forward end of the downward side flanges with a pair of shoulder screws 120, and includes a rear finger hole 121 for rotating the cover plate open to inspect and service the interior components.

The power unit 10 includes the pair of lift arms 68 that act in parallel and have forward ends 69, middle portions 100 and rearward ends 101. The lift arms are interconnected at the rearward ends thereof by a lateral push bar 102, with the respective ends of the push bar slidably retained (in suitable pivotal bushings) within the respective retaining channel 97 of the frame flanges 93; and the forward ends of the lift arms extend toward the forward end 81 of the frame.

The middle portion 100 of the lift arms 68 include an upper cover plate 103 securely welded between the lift arms. The cover plate provides additional strength and stability to the lift arms, and protects some of the internal lifting components of the power unit 10.

A pair of connecting arms 104 act in parallel with the lift arms 68. The connecting arms have forward ends 106 and rearward ends 108, with the respective forward end pivotally connected (at 106) near the forward end of the respective flange 93 of the frame. The respective rearward end is pivotally connected (at 108) on the middle portion 100 of the respective lift arm.

The hydraulic cylinder 89 has the ram 90 at the forward end thereof attached to the center of the lateral push bar 102. When the ram is extended, the push bar and the rearward ends 101 of the lift arms 68 are translated forward along the retaining channels 97 in the flanges 93 of the frame, and the forward ends 69 of the lift arms are thereby raised (in scissor-like fashion with the connecting arms).

As briefly discussed in reference to the jack stand 12, the forward ends 69 of the lift arm 68 of the power unit 10 include a pair of leveling pads 110 that are pivotally attached thereto and act in parallel. The leveling pads have been significantly redesigned to provide additional strength, lifting capacity and durability to the power unit.

Figure 11:
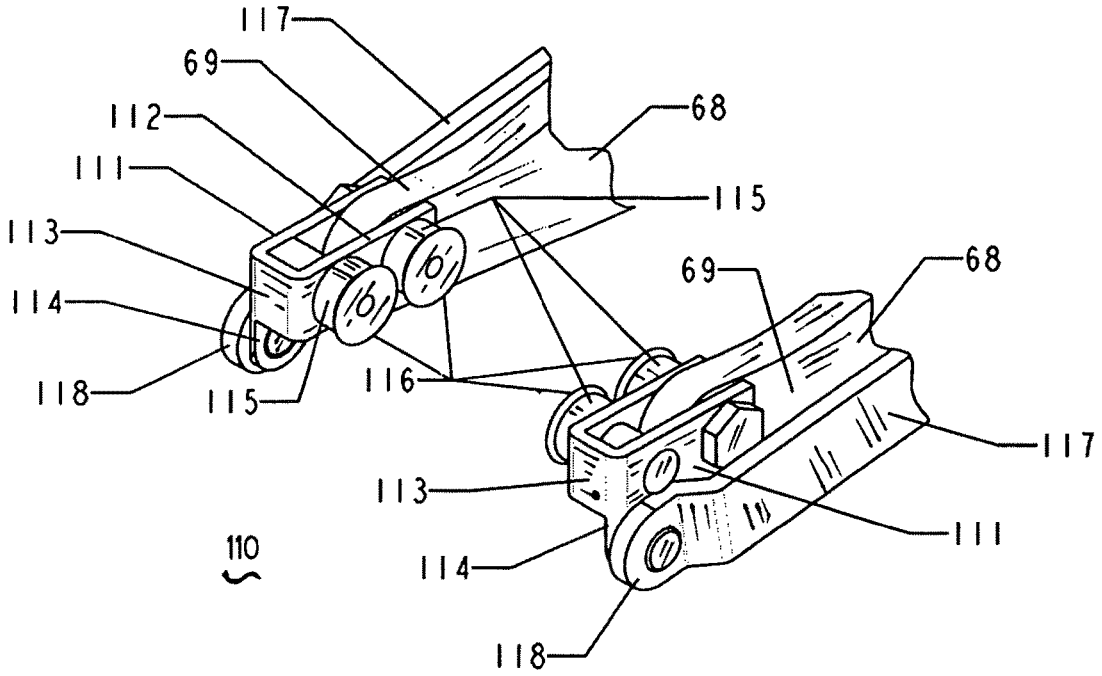
FIG. 11 is a front perspective fragmentary view of forward ends of a pair of lift arms of the power unit showing the improved leveling pads.

Referring now to FIG. 11, the leveling pads 110 of the present invention are shown with the horizontally oriented U-shaped frame having an outer rectangular plate 111 and an inner rectangular plate 112. The inner rectangular plate and the outer rectangular plate provide an open rearward end with the opening about equal to the thickness of the lift arm 68, and form a closed U-shaped forward end 113. Each leveling pad is pivotally attached at the rearward end thereof around the inner and outer sides of the forward end 69 of the respective lift arm.

Each outer rectangular plate 111 of the leveling pad 110 has a downwardly extended lever arm 114 at the forward end thereof for connecting to a leveling link 117. Each leveling link has a forward end 118 pivotally connected to the respective lever arm 114, and is pivotally connected at the other end to a point on the respective connecting arm 104; so that as the forward ends 69 of the lift arms 68 are raised and lowered, the leveling pads are maintained in a substantially horizontal orientation.

Each inner rectangular plate 112 of the leveling pad 110 has the rear cylindrical roller bearing 115 mounted on the inner surface, near the rearward end thereof (through the pivotal connection of the leveling pad to the lift arm), and has an adjacent forward cylindrical roller bearing 115' having the same diameter and thickness, mounted near the forward end thereof. The roller bearings are for engaging the side flanges 73 of the lifting plate 25 of the jack stand 12. The roller bearings 115 have a cylindrical body with a horizontal thickness, and further have inner hubs with a circular flange 116 extending radially outward (vertically) from the inner hub.

The side flanges 73 of the lifting plate 25 of the jack stand 12 have been designed having a length about equal to the length of the leveling pads, and with the rectangular lower surfaces 74 each having a width about equal to the thickness of the roller bearings 115, for maximum engagement. The side flanges of the jack stand further include the vertical inner surface 75 for engaging the circular radial flanges 116 of the roller bearings for additional alignment and stability of the lifting plate on the leveling pads of the power unit (see FIG. 12).

Commercial Power Unit—with Improved Slide-Forward-Bridge

A rectangular plate referenced as a "bridge", when positioned onto the leveling pads at the forward ends of the lift arms, enables the power unit 10 to operate as a hydraulic floor jack. Early designs of the bridge have included a manual two-position bridge, and various designs for an automatic slide forward bridge have been produced. The design of the present invention is a significant improvement over each of the prior designs of the bridge and slide mechanism.

Referring also to FIG. 13, the slide forward bridge 14 of the present invention is shown positioned within one of the lift arms 68 for traversing from a middle position (as shown) to a forward position onto the leveling pads 110. The leveling pads were described in reference to their structure and function for engaging the lifting plate 25 of the jack stand 12, and they further function for engaging and supporting the sides of the bridge. The inner rectangular plate 112 of each leveling pad has a unique length, width and thickness that interact with the sides of the bridge.

The lift arms 68 include a pair of rectangular slide rails 203, each attached (riveted) to the inner side of the respective lift arm, and aligned with the rearward end of the inner rectangular plate 112 of the leveling pad 110. Each of the rectangular slide rails has a length, width and thickness, with the width and thickness about equal to the width and thickness of the inner rectangular plate of the leveling pad.

The length of each slide rail 203 extends from near the forward end 69 of the lift arm 68 rearwardly and parallel along the bottom portion of the lift arm to near the rearward end 101 of the lift arm. The forward ends of the slide rails are suitably spaced from the rearward ends of the inner rectangular plate 112 of the leveling pads 110 so that they do not interfere when the lift arms are elevated; and so that the slide rails are aligned with the inner rectangular plates when the lift arms are in the lowermost position.

The bridge 14 has the general shape of a rectangular block, (rectangular parallelepiped) having a longitudinal length about equal to the length of the inner rectangular plate 112 of the leveling pad 110, and a lateral width slightly less than the width between the inner sides of the lift arms 68. The bridge has a forward end 204, a rearward end 205, rectangular sides 206, a rectangular upper surface 207 having an upward lateral flange 208 at the rearward end thereof, a rectangular lower surface having a downward lateral flange 209 at the forward end thereof. The bridge preferably includes a central vertical threaded opening 210 therein for receiving an extendable screw out saddle (similar to the screw out saddle 24 of the jack stand 12).

The bridge 14 has a first longitudinal recess 211 in each side, running the length thereof and having a width slightly larger than the width of the slide rail 203, and a depth equal to the thickness of the slide rail, so that the bridge can smoothly traverse along the slide rails of the lift arms, and smoothly traverse along the inner rectangular plates 112 of the leveling pads 110.

The bridge 14 has a second longitudinal recess 212 in each side having a width slightly larger than the diameter of the roller bearings 115 and a depth slightly larger than the thickness of the roller bearings. The second recess extends from the forward end of the bridge 204 rearwardly to a vertical stop 213 formed within the second recess. The location of the vertical stop corresponds to the length from the forward end of the inner rectangular plate 112 of the leveling pad 110 to the most rearward radius of the rear roller bearing near the rearward end of the leveling pad. The second recess supports the bridge on the four roller bearings, and the bridge can smoothly traverse on and off of the leveling pads, but is retained by the vertical stop from sliding off the forward end of the leveling pads.

The bridge 14 has a third longitudinal recess 214 extending the same length as the second recess 212, and has a width and thickness slightly larger that the diameter and thickness of the circular radial flange 116 of the roller bearings 115. The third recess is for receiving the circular radial flange therein, and adds alignment and stability for the bridge when it is on the leveling pads 110.

Prior automatic slide forward bridges typically incorporated compression springs (enclosed within channels or telescopic tubes) to bias the bridge in the forwardly direction. This prior design has not been as reliable or durable as desired.

The recesses in the sides of the bridge traversing on the new slide rails 203 and the inner rectangular plates 112 of the leveling pads 110, provide a significant improved function of the bridge. These features alone, coupled with a biasing means including a tension spring attached at one end to the forward end of the lift arms and with the other end attached to a member extended rearward from the rearward end of the bridge, provide a suitable slide forward bridge. However, the bridge is further improved by a pusher frame 215, as described below.

The bridge 14 of the present invention further utilizes the rectangular pusher frame 215 comprising a pair of side plates 216 connected at the forward ends by a lateral member 217, and connected at the rearward ends by a generally vertical lateral plate 218. The pusher frame has a width slightly less than the width between the inner sides of the lift arms 68.

The side plates 216 of the pusher frame each has an outward longitudinal recess 219 for slidably engaging the rectangular slide rails 203 of the lift arms 68. The recesses have a width slightly larger than the width of the slide rails and have a depth about equal to the thickness of the slide rails, and extend the length of the pusher frame. The length of the slide plates of the pusher frame are much longer than (about twice) the width of the pusher frame, and the pusher frame is thus very stable and can smoothly traverse on the slide rails along the lift arms.

The pusher frame 115 is shown as exploded (a short longitudinal distance in FIG. 13) from the bridge 14 to better illustrate the structure of both components. The pusher frame is actually always biased in the forwardly direction with the side plates 216 of the pusher frame directly forcing the sides 206 of the bridge forwardly along the slide plates 203 of the lift arms 68. The pusher frame ultimately forces the bridge onto the leveling pads 110, when there is no jack stand in the frame, and when the inner rectangular plates 112 are aligned with the slide plates of the lift arms (when the power unit is in the lowermost position).

The forward bias of the pusher frame (and thus the bridge 14) is suitably accomplished by a pair of tension springs 220. The rearward lateral plate 218 of the pusher frame has a pair of eyelets 219 at the lower sides thereof for receiving one end of the tension springs; and the forward end of the lift arms have a pair of lower eyelet 222 on the inner surfaces thereof for receiving the other end of the tension springs.

The pusher frame operates so smoothly and stable that a single tension spring (even offset to one side) is sufficient to bias the bridge in the forwardly direction; but preferably, utilizes two tension springs for reliability and durability. The tension springs can further each be enclosed within metallic or plastic tubes (not shown), having a length corresponding to the free length of the spring (or within telescopic tubes to enclose the expanded length of the springs) for a neat appearance and protection for the springs.

Power Unit—with Latching Mechanism for Slide Forward Bridge

Figure 14:
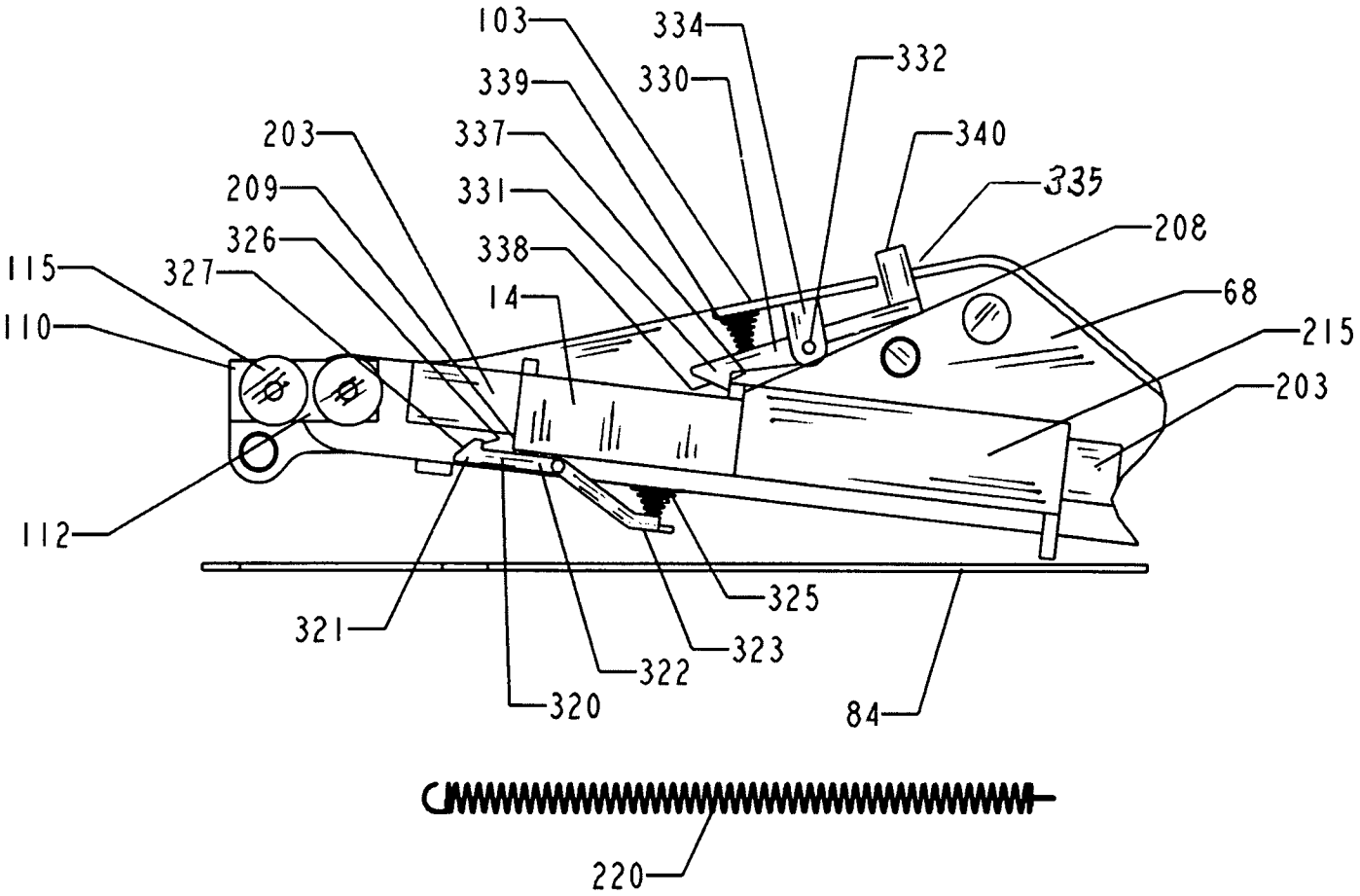
FIG. 14 is a fragmentary side view of one of the lift arms, showing a latching mechanism for the bridge in the middle position.

Referring now to FIG. 14, there is shown the present invention of a combination latching system for securing the slide forward bridge 14 in a middle position within the lift arms 68 of the power unit 10. The power unit is used primarily to operate the jack stands 12, with an occasional use of the bridge so that the power unit can be utilized as a hydraulic floor jack. The bridge includes springs for continuously biasing the bridge in the forwardly direction along the lift arms of the power unit. The bridge and the lift arms have hereby been further improved, so that the bridge can be latched from interfering with the use of the jack stands, to save wear on the bridge, and to selectively release the bridge only when needed.

A lower latch member 320 is shown having a forward end 321, a middle portion 322 and a rearward end 323, with the middle portion pivotally connected (at 322) near the lower inner side of one of the lift arms 68. The lower latch member includes means for biasing the forward end in the upwardly direction. The rearward end is angled rearward and downward extending below the lower side of the lift arm, and is engagable with the bottom 84 of the frame, when the lift arm is in the lowermost position. The rearward end preferably includes a tapered lower compression spring 325 to bias the forward end of the lower latch member in the upwardly direction.

The forward end 321 of the lower latch member 320 has an upward finger 326 thereon that is engagable with the downward lateral flange 209 at the forward end of the bridge 14. (The forward end of the lower latch member is shown slightly forward of the bridge, to better illustrate the features of the engaging components.) The upward finger has a beveled-up nose 337, so that the rearward end of the bridge can initially engage and press down the beveled-up nose, so that the bridge will pass rearwardly over the forward end of the lower latch member, to then be retained (at the downward lateral flange) into the middle position of the lift arm.

In operation, when the bridge 14 is forced to the middle position on the lift arms 68, the bridge is retained by the forward end 321 of the lower latch member 320; whereby when the lift arm is lowered to the lowermost position, the rearward end 323 of the lower latch member is pushed upward by the bottom 84 of the frame, to automatically release the forward end of the lower latch member. The lower latch member can be utilized alone, or can be utilized in combination with an upper latch member 330.

The upper latch member 330 is shown having a forward end 331, a middle portion 332 and a rearward end 333; and operates under the upper cover plate 103 that is securely welded between the middle portions 100 of the lift arms 68. The upper cover plate has a pivot arm 334 extending downwardly therefrom, and further has an aperture 335 therein that is ultimately aligned with and over the rearward end of the upper latch member.

The middle portion 332 of upper latch member 330 is pivotally connected (at 332) to the pivot arm 334 extending downwardly from the upper cover plate 103. The upper latch member includes means for biasing the forward end 331 in the downwardly direction. The forward end has a downward finger 337 that is engagable with the upward lateral flange 208 at the rearward end 205 of the bridge 14. The downward finger has a beveled-down nose 338, so that the rearward end of the bridge can initially engage and press up the beveled-down nose, so that the bridge will pass rearwardly under the forward end of the upper latch member, to then be retained (at the upward lateral flange) in the middle position of the lift arms 68.

The rearward end 333 of the upper latch member 330 has a release button 340 extending upwardly through the aperture 335 in the cover plate 103, to manually operate the upper latch member. The forward end of the upper latch member preferably includes a tapered compression spring 339 that engages the upper cover plate for biasing the forward end of the upper latch member in the downwardly direction.

In operation, when the bridge 14 is forced under the upper latch member 330 to the middle position on the lift arms 68, the bridge is then retained by the forward end 331 of the upper latch member engaging the upward lateral flange 208 at the rearward end of the bridge. The upper latch member is releasable by pressing down on the release button 340 extending through the upper cover plate 103. The upper latch member can be utilized alone as the only retaining mechanism, whereby pressing the release button 340 releases the lift bridge to traverse to the forward ends 69 of the lift arms.

The upper latch member 330 is preferably used in combination with the lower latch member 320, whereby the bridge 14 is retained by both the forward end 331 of the upper latch member and by the forward end 321 of the lower latch member. To release the bridge, the lift arms 68 must be in the lowermost position to release the lower latch member; and then, the release button 340 of the upper latch member must be pressed. If the lift arms are raised prior to pressing the release button, the lower latch member will be reset, and the sequence process must be repeated.

The upper latch member 330 and lower latch member 320 are most preferably utilized in combination with the lower latch member pivotally attached to the lift arm 68, so that it is forward a slight distance from the bridge 14, when the bridge is engaged with the upper latch member (as actually illustrated in FIG. 14).

In operation, this configuration can be efficient when it is contemplated that the bridge 14 will soon be needed. At anytime during the process of lowering of the lift arms 68 of the power unit 10, the release button 340 can be pressed to release the bridge from the upper latch member 330. The bridge will then move forward a slight distance free of engagement with the upper latch member, and be retained only by the lower latch member 320. When the lift arms reach their lowermost position, the lower latch member will automatically be released, and the bridge will advance forwardly, onto the leveling pads 110.

If for any reason the lift arms 68 are not fully lowered, or it is decided to load another jack stand 12 into the power unit 10, the bridge is thereby repositioned by the jack stand rearwardly in the lift arms. The upper latch member 230 and lower latch member 320 are both re-engaged to retain the bridge. This process is repeated unit the bridge is actually needed to advance to the leveling pads 110. The latch members can be biased with springs or elastic components as desired.

Power Unit—with Safety Mechanism for Lift Arms

Figure 15:
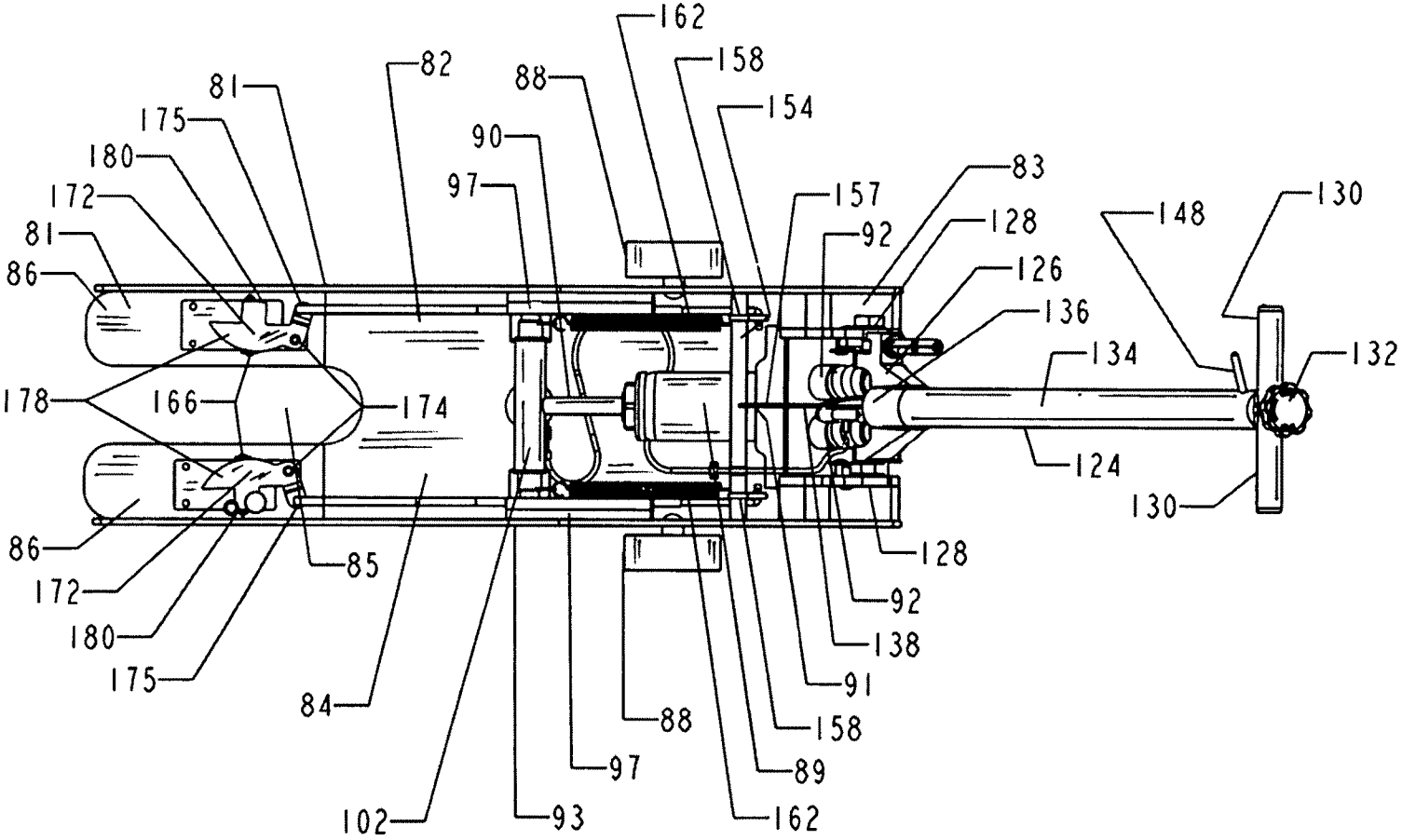
FIG. 15 is a top plan view of the power unit frame, showing some of the control mechanism.
Figure 16:
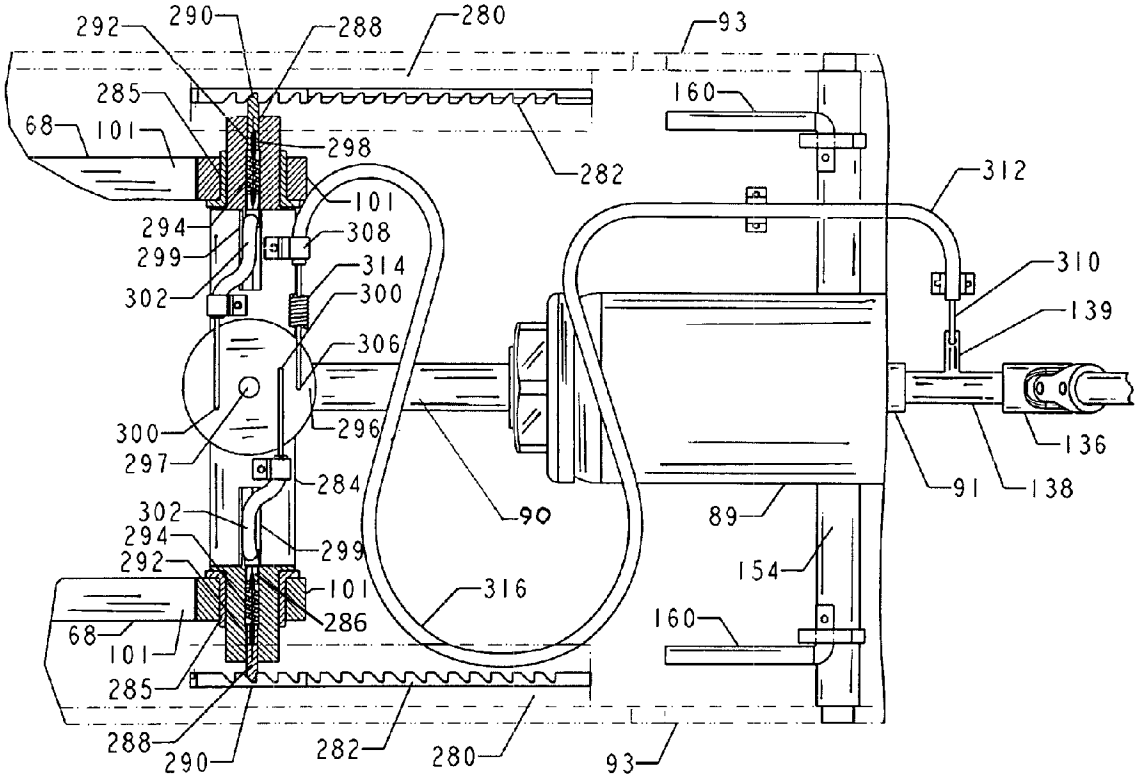
FIG. 16 is a fragmentary sectional bottom of the frame of a power unit, showing a lateral push bar with a safety mechanism for locking the push bar into the sides of guide channel, for locking the position of the lift arms.

Referring now to FIGS. 15 and 16, an improved safety mechanism of the present invention is shown for a power unit (similar to power unit 10, having modifications as described herein) utilizing the bridge 14, and for other hydraulic floor jacks having a pair of scissor type lift arms and a push bar operating within retaining channels.

The present invention is described in terms of a power unit 230, including the same rectangular frame with lift arms 68, connecting arms 104, leveling pads 110, hydraulic cylinder 89 with ram 90 and release valve 91, and the control handle 124 with a control lever 148 and a control knob 132. The frame includes the pair of longitudinal side flanges 93 extending upward therefrom. The power unit has the pivotal lifting means mounted on the frame, including the pair of parallel lift arms 68, having forward ends 69 and rearward ends 101; and the pair of connecting arms 104.

The rearward ends 101 of the lift arms 68 are interconnected by a lateral push bar 284 (that functions like push bar 102), and the forward ends 69 are pivoted upwardly for lifting a load as the push bar is translated forwardly within a pair of longitudinal U channel tracks 280 (somewhat like the U channels 97) attached to the inner side flanges within the frame.

Each U channel track 280 has a ratchet-toothed rack bar 282 facing inwardly along the vertical walls thereof. The rack bars are shown as separate components, but can readily be incorporated directly into the vertical walls of the U channel tracks by machining the teeth, or stamping (coining) the teeth into the vertical walls of the tracks.

The lateral push bar 284 has a pair of bushing 285 on the ends thereof and is positioned for translating within the U channel tracks 280 of the frame. The ends of the push bar each have a bore hole therein for supporting a slidable dog 288. Each bore hole preferably further includes an aligning slot, extending along the upper surface thereof.

The dogs 288 are slidable within the bore holes 286, and each has a narrow vertical distal end 290 thereon that is extendable from the end of the push bar 284 for engagement with a corresponding tooth of the rack bar 282; and has a proximal end 292. Each dog preferably further includes a short aligning rib extending along the top surface thereof and adapted to slide within the aligning slot of the push bar, for aligning the distal end of each dog with the teeth of the respective rack bar. A compression spring 294 is positioned between the proximal end of each dog and the inner bore hole, biasing the distal end of the dog into engagement with the rack bar.

The biased dogs 288 allow the push bar 284 to ratchet forward in the rack bar 282 as it is advanced and as the lift arms are raised. The dogs do not allow the push bar to move backward when the hydraulic pressure is no longer applied to the push bar; thus providing a basic mechanical safety mechanism for the elevated lift arms.

The safety mechanism is shown in FIG. 16 with the push bar 284 extended to the forward position (with forward ends 69 of the lift arms elevated) with the distal ends 290 of the dogs 288 engaged into respective teeth of the rack bar 282. The safety mechanism requires means for selectively releasing the dogs from engagement with the rack bar, so that the forward ends of the lift arms can be lowered, when desired. One such release means incorporates a pivotal disc 296 (for pulling the ends of cables that are attached to the dogs inward).

The lateral push bar 284 further includes a pair of slotted openings 299 therein communicating each central bore hole with the surface of the push bar. The slotted openings provide access to the bore holes of the push bar. (This communication path for the cables could be accomplished with an angled hole from the surface to the bore holes, but a slotted opening or slotted channel is suitable.)

The pivotal disc 296 is oriented horizontally with the center thereof pivotally connected to the lateral push bar 284 at point 297. A pair of release cables (sometimes referred to as bicycle cables) are used that have a fixed sheath 302 with the ends of the cables extending from the sheaths and are slidable therein. Each release cable has the distal end 298 thereof connected to the proximal end 292 of the slidable dog 288, and has a proximal end 300 thereof connected at opposite sides (at 300), near the perimeter of the pivotal disc. The sheaths 302 are fixed to the surface of the push bar; so that a rotation of the disc will pull the cables to retract the distal ends 290 of the dogs; from engagement with the rack bar 282.

The power unit 230 includes the tubular handle 124 with control shaft 134 therein. The control shaft extends from the control knob 132 at the proximal end of the handle, down through the universal joint 136 to the coupling shaft 138 connected to the control valve 91 at the rearward end of the hydraulic cylinder 89. The coupling shaft 138 further includes a radial arm 139 extending laterally therefrom.

A significant feature of the present invention includes a third control cable having a fixed sheath with distal end 308 and proximal end 312, and having a slidable cable therein with a distal end 306 and proximal end 310. The distal end of the cable 306 is attached (at 306) to the perimeter of the pivotal disc 296, and the distal end 308 of the sheath is fixedly attached to the lateral push bar 284. The proximal end 310 of the third control cable is attached to the distal end of radial arm 139, and the proximal end of the sheath 312 is attached to the bottom of the frame.

The control knob 132 and the radial arm 139 are positioned so that the distal end 306 of the third control cable is extended when the control knob is closed (in clockwise position) whereby the control valve 91 is closed and the distal ends 290 of the slidable dogs 188 are extended into the teeth of the rack bar 282. A counter-clockwise rotation of the control knob will thereby pull the distal ends of the control cable, and pivot the disc 296 to pull the release cables 298 to retract the dogs from engagement with the teeth of the rack bar, and then further counter-clockwise rotation will open the control valve 91 to lower the lift arms.

When the load is supported by the safety mechanism (rather than the hydraulic cylinder), there is a rearward force on the lateral push bar 284. The configuration of the teeth in the rack bar 282 and the force of the load on the push bar combine to wedge the distal ends 290 of the dogs 288 into the rack bar, and prevent the disengagement of the dogs while under the load. This is an additional safety feature, and can be readily released with a simple component and step in the procedure.

The control cable further includes a tension spring 314 interconnected to the cable (shown near the distal end 304) so that the control knob can pull the control cable and place the pivotal disc in tension. The handle is pumped once to extend the hydraulic cylinder (and the push bar) a slight distance to relieve the wedge force on the dogs; and the tension spring 314 can then pivot the disc and retract the dogs. The hydraulic pressure can then be slowly released to lower the power unit and the load. The control cable further includes a slacked central portion 316 so that the proximal end thereof attached to the pivotal disc can traverse along the length of the channel tracks with the movement of the push bar.

Controls for Operating the Jack Stand

The controls for operating a jack stand within an earlier design of a power unit has been described in detail in U.S. Pat. No. 7,434,782 by the present inventor and is incorporated herein by reference (see particularly FIGS. 15-23). Similar controls having the same structure and function are utilized in the power unit, having improved leveling pads, of the present invention.

Briefly, as shown in FIGS. 2, 10 and 15-16, the power unit 10 includes a handle and a control mechanism for aligning a jack stand therein.

The power unit 10 includes a tubular handle 124 at the rearward end 83 of the frame having a T bar hand grip 130 at the proximal end thereof and a yoke 126 at the distal end thereof pivotally attached to the sides of the rearward end of the frame. The handle and the yoke are used for maneuvering the power unit about on its wheels 88, for pumping the handle to actuate the hydraulic cylinder 89, and for controlling the inter-engagement of the power unit with the jack stand 12.

The rotatable control knob 132 has a control shaft 134 extending from the control knob through the tubular handle 124 to the distal end thereof; and the distal end of the control shaft is attached to one end of a universal joint 136. The universal joint has the other end attached to a coupling shaft 138, which has the other end connected to the control valve 91 of the cylinder 89.

The power unit 10 has an alignment pin block 164 horizontally and transversely attached to each forward extension 86, for aligning the jack stand therein. An alignment pin 166 is slidably supported within each pin block and has the distal end extending horizontally and inwardly from the pin block, for being received within the alignment hole 31 of the jack stand 12. The proximal end of the alignment pin includes a compression spring 170 thereon, for biasing the alignment pin inwardly; and has a pin tab 168 attached to the outermost proximal end thereof.

The alignment pin block 164 has a pair of horizontally oriented, generally rectangular shaped flippers 172 pivotally mounted at the inner rearward corner on post 174 extending vertically on each forward extension 86. Each flipper has an arcuate inner edge 176 which is selectively engageable with the associated ratchet release arm 40 of the jack stand 12. Each flipper has an outer edge which has a downward extending tab 178 that fits within the pin tab 168 of the associated alignment pin 166 and is selectively engagable to retract the associated alignment pin.

The tubular handle 124 further includes the operating lever 148 extending lateral from an upper opening 149 therein, and control means (torsion tube 154 and control rods 160) coupling the operating lever to the outer rearward corners 175 of both of the flippers 172. The control lever thereby is for controlling both ratchet release arms 40 and both of the locking alignment pins 166, for controlling the attachment of the power unit to a jack stand, the release and non-release of the jack stand pawls, and the detachment of the power unit from the jack stand.

When the jack stand 12 is locked into the power unit 10 and is placed in the desired location to lift a load, the operator rotates the control knob 132 (in the clockwise direction) to lock the pressure valve 91 of the hydraulic cylinder 89. The operator positions the control lever 148 in the intermediate notch 181 of opening 149 of the handle 124. The operator then pumps the handle to energize the hydraulic cylinder to raise the forward ends of the lift arms 68 under the lifting plate 27 of the jack stand, to lift the load. The pawls 37 of the ratchet arms 36 engage successive ratchet teeth 32, 42 of the tubular frames 22, 23 as the jack stand is raised to the desired elevation.

When the load has been raised to the desired elevation, the pumping of the handle 124 is naturally discontinued. The control knob 132 on the handle is rotated (in the counter-clockwise direction) to release the pressure in the hydraulic cylinder 89. The lift arms 68 will drop down into the frame, leaving the load supported solely by the extended tubular frames of the jack stand 12, locked in position by the pawls 37 of the ratchet arms 36. The control lever 148 is then pulled upward to the edge 182 of the opening 149 in the handle, for releasing the aligning pins 166 of the power unit from the jack stand. The power unit can then be disengaged from the jack stand, leaving the load mechanically supported solely by the jack stand.

When the load is to be lowered, the control lever 148 is placed in the lower notch 180, and the power unit 10 is aligned with and locked to base assembly 26 of the elevated jack stand 12. The control knob 132 is rotated to the clockwise position, and the operator pumps the handle to raise the lift arms upward and under the lifting plate of the jack stand. The operator then positions the control lever to rest in the intermediate notch, 181, whereby the lateral edges 176 of flippers 172 are pressing inward against the respective lower ends 40 the release arms 36. However, the pawls 37 do not then release, because the configuration of the ratchet teeth and the weight of the vertical load on the respective frame combine to wedge the pawls into the ratchet teeth, and prevent the disengagement of the pawls.

The next step to lower the load is to pump the handle 124 to extend the lift arms 68 to raise the lifting plate 27 at least a slight amount. This action relieves the vertical load on the ratchet teeth so that the flippers can then press the lower ends 40 of the ratchet arms 36 inward, thereby permitting the pawls 37 to disengage from the ratchet teeth. The operator then slowly rotates the control knob (counter-clockwise) to release the hydraulic pressure and thus the lift arms 68, and the extended tubular frames of the jack stand 12 descend and telescope into each other, allowing the load to be lowered.

The simple T bar hand grip 130 with the central control knob 132 and the right side control lever 148 are very straight forward for the operator to quickly understand, and are very simple to operate. An operator can load a jack stand 12 into the power unit 10, position the jack stand, raise the jack stand, and finally lower the jack stand, all with only the need to use one hand to control the hand grip, position the control knob and position the control lever.

Commercial Power Unit—Controls for Positioning the Handle

The controls for positioning the handle of the power unit, within an earlier design of a power unit, is described in detail in U.S. Pat. No. 8,083,210 by the present inventor, and is incorporated herein by reference. Similar controls having the same structure and function are utilized in the power unit, having improved leveling pads, of the present invention.

Briefly, as shown in FIGS. 1 and 15, the handle control mechanism 129 having the tubular handle 124 with yoke 126 pivotally attached to a pair of vertical side brackets 127. One side brackets has a series of arcuate upper surfaces concentric with the lateral axel of the yoke. The upper surfaces include a large radius forward portion, then a small radius arcuate notch portion, then an intermediate radius rearward portion. The yoke has a barrel aligned radially over the circular upper surfaces of the side bracket, with a plunger therein having an upper end extending above the barrel and a lower end for extending below the barrel and into the arcuate notch portion.

A plunger control level 129' has a rectangular distal end that is pivotally attached to the upper end of the plunger. The control lever can position the plunger to fully extended into the arcuate notch portion for fixing the movement of the tubular handle; and can position the plunger to partially extend into the arcuate notch portion for freeing the handle to pump the hydraulic cylinder; and can retract the plunger from the arcuate notch portion for folding the handle over the hydraulic jack.

Mobile Rack for Transporting Jack Stands

As previously discussed, many lifting projects require several jack stands. The power unit had to be moved back to the supply of jack stands to load an additional stand within the base and then back to the project, or additional stands needed to be somehow carried to the respective power unit to continue the lifting project. The two part jacking system is also utilized on service vehicles for service calls to remote locations that require several stands. It was necessary to develop a suitable rack for transporting the jack stands.

Referring again to FIGS. 17 and 18, there is shown a first embodiment of the mobile rack 350 of the present invention. The rack includes the rectangular platform 351 having a rearward end 352, a forward end 353, a loading and unloading lateral side 354, a non-loading lateral side 355, a width larger than the jack-stand length L, and having a length equal to a multiple of the jack stand width W's. The rack can be designed to transport 2-6 jack stands, and preferably to transport 4 jack stands.

Referring also to FIG. 9, the bottom plate 27 of the jack stand 12 is shown having the longitudinal length L, the lateral width W, and a plate thickness. The bottom plate has the first rectangular opening 78 therein located at about the center of the lateral width ½W, and at about ¾L of the bottom plate length from the rearward end 352; and has a duplicate opening 78' located at about the lateral center and about ¾L of the bottom plate length from the forward end 353 thereof.

The openings 78 and 78' in the bottom plate 27 of the jack stand 12, each has a width and length (i.e. about 33 mm×33 mm). The duplicate openings allow the jack stand to be loaded onto the mobile rack 350 from either end of the jack stand (there will always be one of the openings located ¾L from the rearward end of the jack stand, as loaded).

The platform 351 of the rack 350 includes a plurality of L shaped lateral fingers 360 extending upwardly, and located on the platform at points corresponding to the centers of the jack-stand-widths of adjacent respective jack stands (W/2, W, etc.) along the length of the platform, and laterally at points corresponding to about ¾ of the jack-stand length (¾L) from the loading side 354 of the platform.

Each lateral finger 360 includes an upper rectangular surface 361 having a width and length, (i.e. about 20 mm×25 mm) and having an opening 363 (between the platform and the lateral rectangular surface of the finger) that is slightly greater than the thickness of the bottom plate 27 of the jack stand 12. The openings of the fingers face the non-loading side 355 of the platform (see FIG. 18). The fingers are preferably welded to the platform, but could be directly formed by stamping the total length of the rectangular finger (3 sides thereof) from the platform, then folding the vertical portion upward, and folding the upper rectangular surface horizontally to complete each finger.

The dimensions of the rectangular openings 78, 78' of the jack stand 12 and the rectangular upper surfaces 361 of the fingers 360 of the rack 350 are not specifically critical. It is important that the width and length of the openings 78, 78' in the jack stand are greater than the width and length of the rectangular upper surfaces 361 of the fingers on the platform of the rack. It is also important that the openings 363 between the fingers and the platform are slightly greater than the thickness of the bottom plate 27 of the jack stand 12.

The platform 351 further includes a horizontal reinforcing frame 367 having a thickness of about the bottom plate 27 of the jack stand 12, and extending along the rearward end, the forward end and the loading side thereof. The frame is around the platform and increases the size of the rack, but does not reduce the length or width of the platform. (The platform is further extended to include the shape of the reinforcing frame.) The frame adds strength, rigidity, and is convenient for attaching the wheels and handle means to the platform.

The platform 351 further includes pairs of flanges 362 extending upwardly and rearwardly from the frame 367 at the rearward sides of the platform, for mounting a pair of axels and wheels 364. The wheels are positioned so that the platform is flatly engaged with the surface when the forward end 353 of the platform is lowered (for loading and unloading jack stands); and so that the wheels engage the surface (and the platform does not engage the surface) when the forward end of the platform is elevated at an acute angle (for transporting the rack).

The rack 350 includes a pair of upward flanges 365 attached to the reinforcing frame 367 at the forward end 353 to support a lateral bar handle 366. The handle is utilized to raise and lower the forward end of the rack; and once elevated, for pulling (or pushing) the rack to a desired location.

To load the jack stands 12 onto the mobile rack 350, each jack stand is placed onto the platform 351 so that the respective opening 78, 78' of the bottom plate 27 is positioned over a respective finger 360 of the platform, and the bottom plate is resting flatly on the platform. The bottom plate is then slid laterally toward the loading side 354 of the rack, whereby the bottom plate (adjacent the opening 78, 78') is secured under the respective finger of the rack. The sequence is repeated to load the rack with jack stands, and they are then ready to transport.

The mobile rack 350 is similarly unloaded, by sliding the respective jack stand 12 laterally toward the non-loading side 355 of the platform 351 (a short distance) until the opening 78 of the bottom plate 27 is no longer within the opening 363 between the finger 360 and the platform 351. The jack stand can then be lifted upward and away from the finger, the platform and the rack; and is ready for use by the power unit 10.

Figure 19:
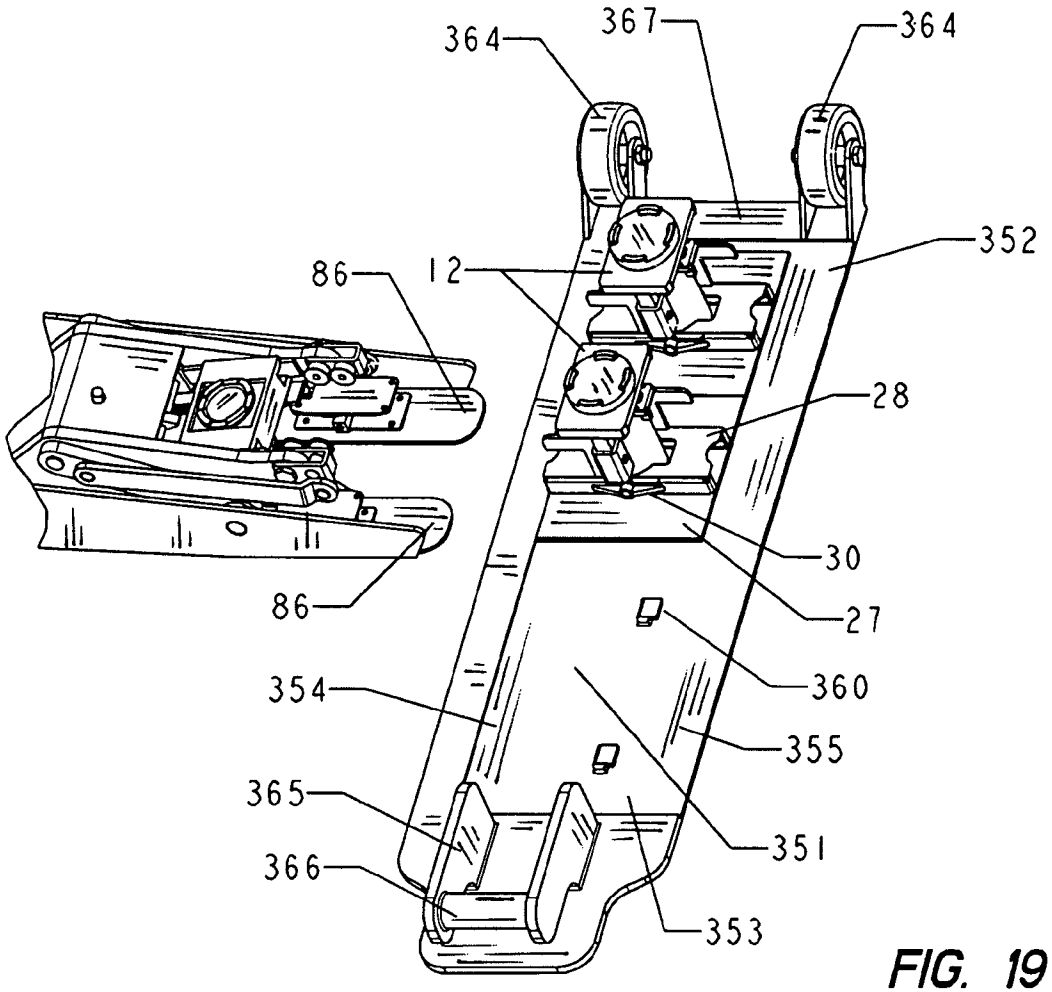
FIG. 19 is a top front perspective view of the rack of FIG. 17 showing the jack stands loading to and unloading from the rack.

Referring now to FIG. 19, the jack stands 12 are shown being loaded onto (or unloaded from) the mobile rack 350 by utilizing the power unit 10. The jack stands can of course be loaded and unloaded manually on and off of the rack, but it is very easy and convenient to let the power unit perform the bending and lifting to position and secure the jacks onto the rack.

As previously discussed in the operation of the two-part jacking system, the separated extensions 86 of the power unit 10 are positioned to slide over the bottom plate 27 of the jack stand 12, to engage the upper plate 28 under the ramp and side rails 30. The power unit then locks the jack stand into the forward end thereof. The power unit then readily positions the jack stand onto the platform 351 from the loading side 354 of the rack, so that the respective opening 78, 78' is over the respective finger 360; then slides the jack stand laterally under the finger, and then releases the jack stand and withdraws the power unit. The power unit repeats this procedure until the rack is loaded.

The power unit 10 can similarly be utilized to unload the jack stands 12 from the rack 350. The power unit first locks onto a jack stand from the loading/unloading side 354 of the rack. The power unit then slides the jack stand laterally toward the non-loading side 355, so that the bottom plate is free from under the finger 360 (the bottom plate adjacent the opening 78 abutting the upward portion of the finger 360); and then lifts the jack stand upward over the finger, and then rearward off of the rack.

The jack stands can also the loaded and unloaded from what is referenced herein as the "non-loading" lateral side 355. This nomenclature is somewhat arbitrary just to clarify the function of the components; however, it has been found that the power unit is much easier to finely control when pulling it rearward, rather than pushing it forward in close spaces. It remains preferable to load and unload the jack stands from the loading and unloading lateral side 354.

Figure 20:
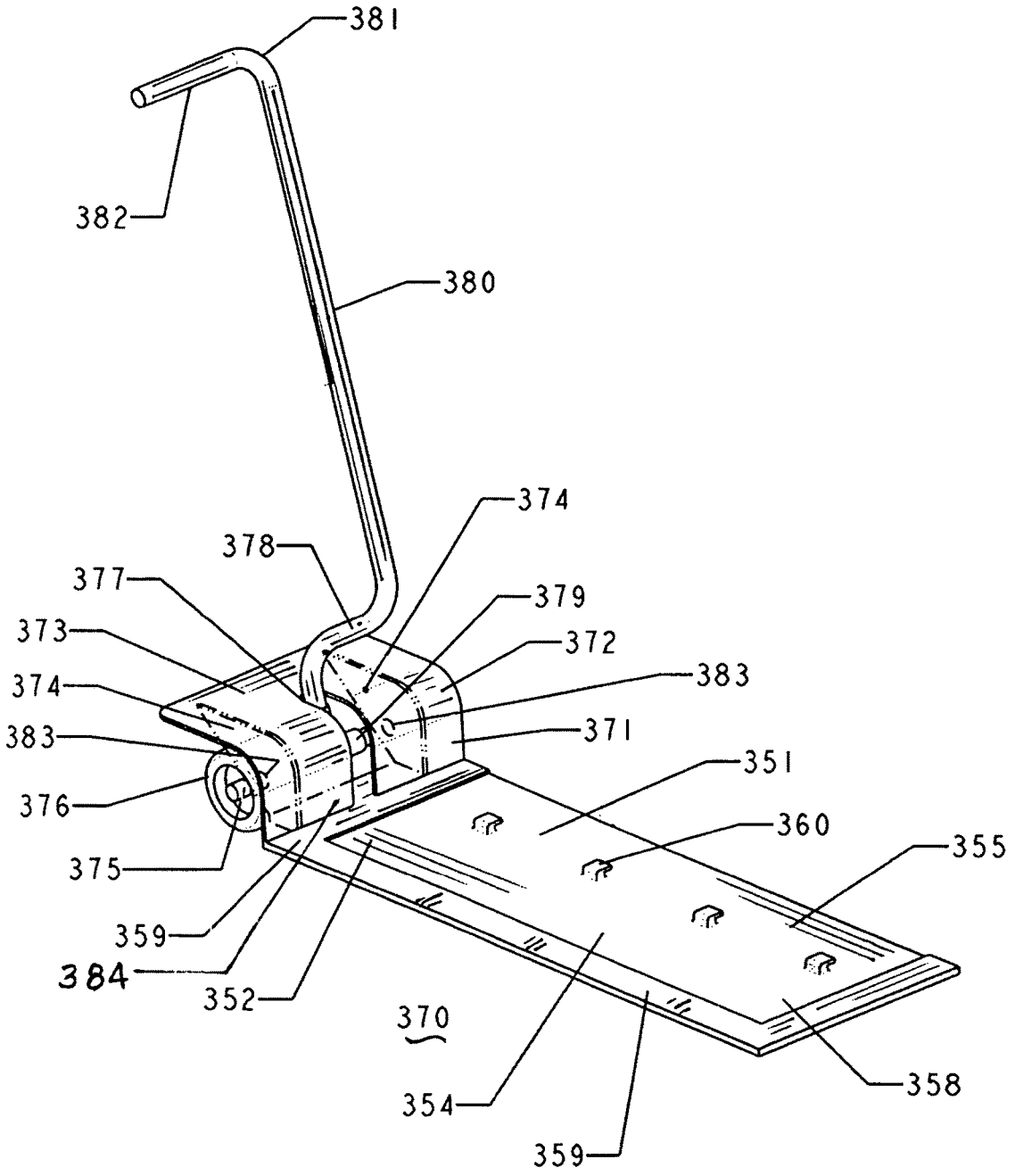
FIG. 20 is a top front perspective view of another embodiment of a rack for transporting two or more jack stands.
Figure 21:
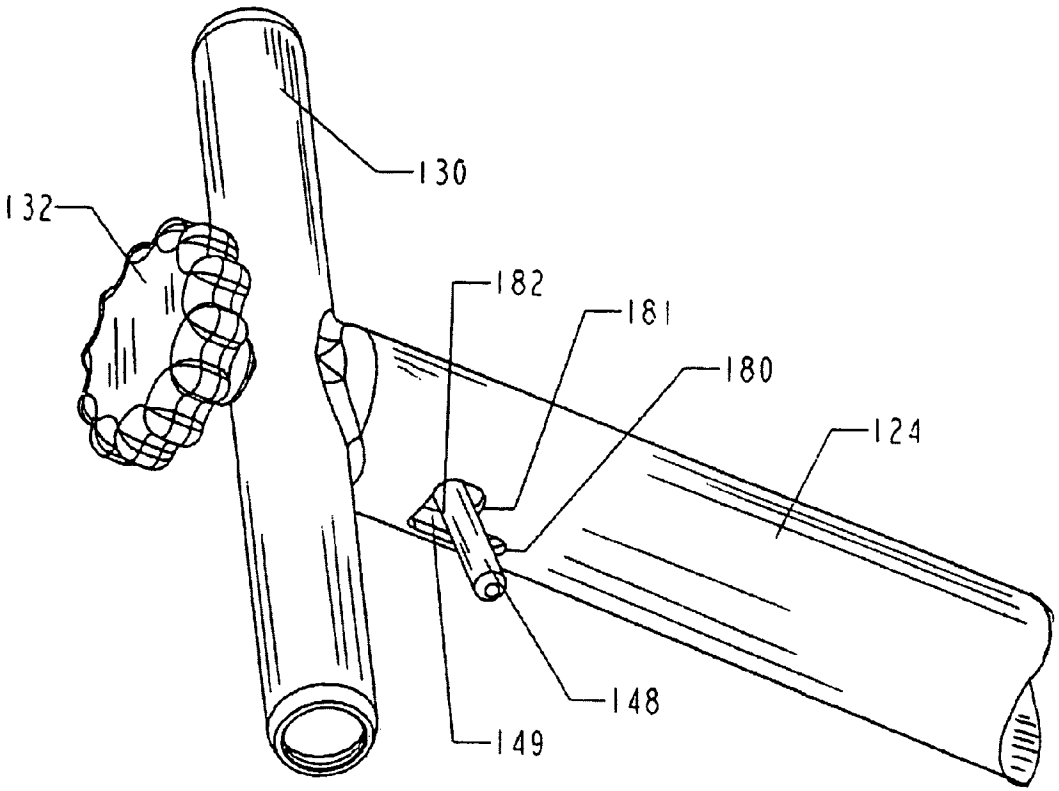
FIG. 21 is top front perspective view of the upper end of the handle of the power unit.

Referring now to FIG. 20, there is shown a second embodiment of the present invention for a mobile rack 370. Rack 370 has the rectangular platform 351 having the plurality of L-shaped fingers 360 extending upwardly therefrom. The platform and fingers have the same structure, location and function as those previously described in reference to mobile rack 350.

The Rack 370 includes a reinforcing frame 359 (similar to reinforcing frame 367 discussed in reference to Rack 350) extending around the forward end 358, loading side 354, and the rearward end 352 (but does not include a handle at the forward end, and thus has the blunt forward end 358). A wheel cover 371 has a front end attached to the reinforcing frame 359 at the rear end of the platform, a middle portion 372, and a rearward end 373, and has a pair of longitudinal vertical flanges 374 (shown in phantom lines) extending downwardly therein. The flanges are for supporting a lateral axel 375 and a pair of wheels 376. the axel, to further support the vertical flanges.

The lateral axel 375 is interconnected to the pair of wheels 376. Each wheel has an inner side and an outer side, with the interconnected outer sides having a combined width about equal to the width of the rearward end 352 of the reinforcing frame 359.

The vertical flanges 374, within the wheel cover 371, are each laterally positioned to be adjacent to the inner side of the respective wheel 376, and have apertures 383 therein. The axel 375 is positioned within the apertures and the wheels are attached to the axel. The apertures of the flanges are located to support the wheels upwardly and rearwardly relative to the platform, so that the platform engages the horizontal surface when the forward end of the platform is lowered, and so that the wheels engage the horizontal surface when the forward end of the platform is lifted to an acute angle. The reinforcing frame further includes a rectangular extension 384 extending laterally between the inner sides of the wheels and longitudinally from the back of the frame to about under the center of the axel for supporting the flanges.

The wheel cover 371 further extends upwardly, and then the middle portion 372 extends concentrically over the wheels and then rearwardly to the rearward end thereof.

The vertical flanges 374 further each have a generally "tear drop" shape having an upper curved shape conforming to the shape of the wheel cover 371, and having a lower curved shape extending from the rearward end of the wheel cover 373, under the aperture 383, and forward to the rearward end of the reinforcing frame 384. The vertical flanges are positioned and shaped to provide maximum support for the wheels and for the wheel cover of the rack.

The wheel cover 371 further has a longitudinal slotted opening 377 therein, extending from the front end thereof to near the rearward end thereof. The slotted opening acts at a guide and stop for a pivotal tubular handle 378.

The tubular handle 378 has a lower end 379 pivotally attached to the axel 375 (i.e. a tubular T around the axel with the upper end welded to the lower end of the handle) and extends upwardly through the slotted opening 377 in the wheel cover 371. The handle has a middle portion 380, and has an upper end 381 with a lateral bar handle 382.

The handle 378 is pivotable to an upwardly and rearwardly position where the lower end 378 is stopped at the rearward end of the slotted opening 377. The upper end of the handle 381 can then be further pushed (or pulled) rearwardly against the stop, to pivot the platform 351 about the wheels 376, for lifting the forward end 358 of the platform upward to an acute angle. The pivoted rack can then be readily pushed or pulled by the handle for transporting the jacks to a desired location. By simply relaxing the rearward force on the handle, the platform is returned to the lowered position for loading and unloading the jack stands.

The tubular handle 378 of rack 370 preferable has a shape contoured to fit around the rearward end 352, the non loading side 355, and the forward end 358 of the platform 351 (as shown in FIG. 20. The contoured shape allows the handle to be readily folded over the platform and around any jack stands loaded on the rack, when not in use.

Referring again to FIG. 17, the rear handle concept of rack 370 can be applied to the platform of rack 350. A tubular handle (like handle 378) having the lower end pivotally attached to the frame at the rearward end of the platform, and having a stop thereon; and having the upper end extending upwardly and rearwardly at an angle, whereas the upper end can be further pushed or pulled rearwardly and downwardly for pivoting the platform about the wheels 364, whereby the forward end of the platform is elevated to an acute angle, for transporting the rack 350, It is concluded that the foregoing designs and improvements to the commercial power units and the commercial jack stand provide reliable and durable commercial use. The respective present invention provides a power unit with leveling pads having a capacity of at least 3 tons and extended reliable use;

The commercial power unit has an improved slide forward bridge mechanism having a capacity of at least 3 tons that is precisely aligned, smoothly operated within the lift arms by tension springs, and reliable and durable in operation. The power unit has a releasable latch mechanism for retaining the slide forward bridge in the middle position, until needed. The power unit further includes an improved safety mechanism for securing the lift arms when the slide forward bridge is in use, and which is automatically released when the lift arms are lowered.

The commercial jack stand includes a bumper that effectively pushes the slide forward bridge into the middle position when the jack stand is positioned into the front base of the power unit. The jack stand has an improved bottom plate that facilitates securing the jack stands into the mobile rack. A mobile rack has been provided for transporting two or more jack stands to various locations for use by the power unit.

While specific embodiments and examples of the present invention have been illustrated and described herein, it is realized that modifications and changes will occur to those skilled in the art. It is therefore to be understood that the appended claims are intended to cover all such modifications and changes as may fall within the spirit and scope of the invention.

ELEMENTS

10 Power unit
12 Jack stand
14 Slide forward bridge
16, 16' bumper for Jack stand
17 vertical portion
21 Jack Stand 1$^{st}$ frame
22 2$^{nd}$ frame
23 3$^{rd}$ frame
24 4$^{th}$ frame- screw-out saddle
25 lifting plate
26 base assembly
27 bottom plate
28 upper plate
30 ramps (side rails)
31 aligning holes
32 ratchet teeth (in 22)
33 vertical groove (in 22)
34 (short) pin
35 ratchet arm housing
36 ratchet arm
37 pawl
38 pivot pin
39 (compression) spring
40 lower end
42 ratchet teeth (in 23)
43 vertical groove (in 23)
44 (short) pin
45 horizontal groove (in 23)
46 finger
47 guide member
48 recessed channels
49 slotted opening
50 latch member (Jack Stand)
51 slotted opening
52 springs
53 curved inner end
54 inward edge (slot in latch)
55 outward edge (slot in latch)
56 outer end
57 notches
58 cover
59 dome
60 flange
62 finger- upper end
63 angled outward surface
64 angled inward surface
65 vertical portion
66 clearance portion
68 parallel lift arms (of power unit 10)
69 forward ends
(25 Lifting Plate)
71 forward end
72 rearward end
73 side flangs
74 rectangular bottom surface
75 vertical inner surface
76 recesses
78, 78' rectangular openings (Bottom plate)
(10 POWER UNIT)
rectangular frame
81 forward end
82 middle portion
83 rearward end
84 bottom
85 slotted opening
86 extensions (separated)
88 wheels
89 hydraulic cylinder
90 ram
91 control valve
92 dual piston actuators
93 longitudinal side flanges
95 rounded vertical nose
96 blunted vertical tail
97 U channel tracks
98 rear cover plate
99 downward side flanges
100 (Lift Arms) middle portion
101 rearward ends -continued

| ELEMENTS |
|---|
| 102 lateral push bar |
| 103 upper cover plate |
| 104 connecting arm |
| 106 forward end |
| 108 rearward end |
| 110 leveling pad |
| 111 outer rectangular plate |
| 112 inner rectangular plate |
| 113 U shaped forward end |
| 114 lever arm, down from outer plate |
| 115 roller bearings |
| 116 circular radial flanges |
| 117 leveling link (forward end) |
| 118 leveling link (other end) |
| 120 shoulder screws (in cover plate) |
| 121 rear finger opening |
| 124 tubular handle |
| 126 yoke |
| 127 vertical side brackets |
| 129, 129' handle control mechanism |
| 130 T bar hand grip |
| 132 control knob |
| 134 control shaft |
| 136 Universal joint |
| 138 coupling shaft (to valve 91) |
| 139 radial arm (from coupling shaft) |
| 148 control lever |
| 149 opening (P shaped in handle 124) |
| 154 torsion tube |
| 160 operating rod |
| 164 alignment pin block |
| 166 alignment pin |
| 168 pin tab |
| 170 spring (compression) |
| 172 flippers |
| 174 vertical post |
| 175 corner (connected to rod 160) |
| 176 inner edge |
| 178 downward tab |
| 180 (opening 149) lower notch |
| 181 intermediate notch |
| 182 upper end edge |
| 203 rectangular slide plate (inner lift arms) |
| 204 (Bridge 14)- forward end |
| 205 rearward end |
| 206 rectangular sides |
| 207 rectangular upper surface |
| 208 upward lateral flange |
| 209 downward lateral flange (lower surface) |
| 210 threaded opening in bridge |
| 211 first longitudinal recess |
| 212 second longitudinal recess |
| 213 stop in 2$^{nd}$ recess |
| 214 third longitudinal recess |
| 215 Pusher Frame |
| 216 side plates |
| 217 forward lateral member |
| 218 rearward lateral plate |
| 219 longitudinal recesses |
| 220 tension springs |
| 221 eyelets in rearward lateral plate |
| 222 eyelets at forward end of lift arm |
| 230 power unit (2$^{nd}$ embodiment) Safety |
| 280 U-Channel tracks |
| 282 vertical rack bar |
| 284 lateral push bar |
| 286 bore holes |
| 288 slidable dogs |
| 290 distal end |
| 292 proximal end |
| 294 spring |
| 296 pivotal disc |
| 297 point of connection (disc to push bar) |
| 298 distal end of cable (to dog) |
| 299 slotted opening (to center bore) |
| 300 proximal ends & connection to disc |
| 302 fixed sheath |

-continued

| ELEMENTS |
|---|
| 306 3$^{rd}$ cable-distal end & connection to disc |
| 308 distal end of sheath |
| 310 proximal end of cable |
| 312 proximal end of sheath |
| 314 tension spring |
| 316 Slacked portion of cable |
| 320 Lower Latch Member |
| 321 forward end |
| 322 middle portion & pivotal connection |
| 323 rearward end |
| 325 lower compression spring |
| 326 upward finger (forward end) |
| 327 beveled up nose |
| 330 Upper latch Member |
| 331 forward end |
| 332 middle portion & pivotal connection |
| 333 rearward end |
| 334 pivot arm extend down from cover |
| 335 aperture in upper cover |
| 337 downward finger (forward end) |
| 338 beveled down nose |
| 339 compression spring |
| 340 release button |
| 350 1$^{st}$ Mobile Rack |
| 351 rectangular platform |
| 352 rearward end |
| 353 forward end |
| 354 loading lateral side |
| 355 non loading lateral side |
| 356 width |
| 357 length |
| 360 L shaped upward finger |
| 361 rectangular upper surface |
| 362 flanges for wheels |
| 363 opening under finger |
| 364 pair of wheels |
| 365 upward flange arms |
| 366 lateral bar handle |
| 367 reinforcement frame |
| 370 2$^{nd}$ Mobile Rack |
| (351 platform) |
| (360 finger) |
| 358 front end |
| 359 reinforcment frame |
| 371 Wheel cover |
| 372 middle portion |
| 373 rear end |
| 374 long vertical flanges |
| 375 lateral axel |
| 376 wheels |
| 377 slotted opening in wheel cover |
| 378 tubular handle |
| 379 lower end |
| 380 middle portion (conforms to platform |
| 381 upper end |
| 382 lateral bar |
| 383 apetures in flangs 374 |
| 384 rectangular rear end of frame 359 |

The invention claimed is:

1. A commercial power unit and safety mechanism for a hydraulic floor jack, comprising:

a rectangular frame having a forward end, a rearward end, and sides with the rearward end having a tubular control handle extending therefrom with a control knob at the upper end of the handle;

a pair of longitudinal side flanges extending upward from the frame; a pivotal lifting means mounted on the frame including a pair of parallel lift arms having rearward ends interconnected by a lateral push bar and having forward ends rotatable upward for lifting a load;

a pair of longitudinal U channel tracks facing inward and attached to the inner side flanges within the frame and retaining the ends of the lateral push bar therein;

a hydraulic cylinder having an extendable ram for pushing the lateral push bar forward along the tracks for raising the forward ends of the lift arms, and a releasable control valve for retracting the ram and the lateral push bar for lowering the forward ends of the lift arms;

the tubular handle enclosing a control shaft extending from the control knob to the releasable control valve;

the control knob is rotatable in the clockwise direction to close the release valve and is rotatable in the counter-clock-wise direction to release the control valve;

the power unit further including a rectangular block bridge for positioning on and across the forward ends of the lift arms, whereby the power unit functions as a hydraulic floor jack;

the safety mechanism comprising:

a toothed rack bar secured on the vertical wall of at least one of the U channel tracks and extending from the rearward end to the forward end thereof;

the lateral push bar having a bore hole in at least one of the ends thereof;

a generally cylindrical dog slidably supported within each said bore hole of the push bar and having a proximal end thereof, and having a distal end thereof extendable from the end of the push bar for engaging a respective tooth of said rack bar, whereby said dog is for advancing the push bar in the forward direction and securing the push bar from retracting in the rearward direction;

biasing means urging the distal end of each said dog into the respective tooth of each said rack bar, for mechanically securing the push bar as it is advanced within the tracks, whereby the lift arms are retained in the respective elevated position independent of any release of pressure by the hydraulic cylinder, and means for releasing each said dog from said rack bar by rotation of the control knob in the counter-clockwise direction, whereby the safety mechanism is automatically disengaged with the release of the control valve.

2. The commercial power unit and safety mechanism as defined in claim 1, wherein the release means further comprises:

a short radial arm extending from the control shaft near the control valve of the cylinder;

the lateral push bar further having a slotted opening therein communicating each of the central bore holes with the surface of the push bar;

a control disc oriented horizontally and pivotally connected at the center thereof to the lateral push bar;

a release cable slidable within a cable sheath thereon and having a distal end thereof connected to the proximal end of each said dog, and having a proximal end thereof connected near the perimeter of said pivotal disc, and having the sheath fixedly attached to the push bar; whereby a pivotal rotation of said disc will pull said release cable to retract each said dog from engagement with said rack bar, and a control cable slidable enclosed within a cable sheath and having a distal end thereof attached to the perimeter of said pivotal disc, and having the distal end of the control cable sheath attached to the lateral push bar, and having the proximal end of the control cable attached to said arm on the control shaft, and having the proximal end of the control cable sheath attached to the frame so that a counter-clockwise rotation on the control knob will release the control valve, and will pull said control cable for rotating said disc.

3. The commercial power unit and safety mechanism as defined in claim 2, wherein said biasing means includes a compression spring in each said bore hole acting on the proximal end of each said slidable dog.

4. The commercial power unit and safety mechanism as defined in claim 2, wherein the configuration of the teeth of said rack bar and the distal end of said dog combine to wedge the distal end of said dog into engagement with said rack bar when there is rearward force exceeding the forward force on the lateral push bar, and wherein, said control cable further includes a tension spring interconnected thereto, so that a pull on the control knob expands said tension spring for not retracting said dog when there is a rearward force exceeding the forward force on the lateral push bar, and for retracting said dog when there is a forward force exceeding the rearward force on the lateral push bar.

5. The commercial power unit and safety mechanism as defined in claim 2 wherein, said rack bar is attached to each of the U channel tracks.

* * * * *